US010074273B2

(12) United States Patent
Yokoyama et al.

(10) Patent No.: US 10,074,273 B2
(45) Date of Patent: Sep. 11, 2018

(54) TRAFFIC SIGNAL CONTROL APPARATUS, TRAFFIC SIGNAL CONTROL METHOD, AND COMPUTER PROGRAM

(71) Applicant: SUMITOMO ELECTRIC INDUSTRIES, LTD., Osaka-shi, Osaka (JP)

(72) Inventors: Ryo Yokoyama, Osaka (JP); Osamu Hattori, Osaka (JP)

(73) Assignee: SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/306,526

(22) PCT Filed: Apr. 23, 2015

(86) PCT No.: PCT/JP2015/062370
§ 371 (c)(1),
(2) Date: Oct. 25, 2016

(87) PCT Pub. No.: WO2015/166876
PCT Pub. Date: Nov. 5, 2015

(65) Prior Publication Data

US 2017/0053529 A1 Feb. 23, 2017

(30) Foreign Application Priority Data

May 1, 2014 (JP) ..... 2014-094711

(51) Int. Cl.
*G08G 1/07* (2006.01)
*G08G 1/081* (2006.01)
(Continued)

(52) U.S. Cl.
CPC ..... *G08G 1/081* (2013.01); *G08G 1/012* (2013.01); *G08G 1/0112* (2013.01);
(Continued)

(58) Field of Classification Search
CPC ..... G08G 1/081; G08G 1/0145; G08G 1/095; G08G 1/096741; G08G 1/096783;
(Continued)

(56) References Cited

U.S. PATENT DOCUMENTS 5,257,194 A * 10/1993 Sakita ..... G08G 1/081 340/911
6,339,383 B1 * 1/2002 Kobayashi ..... G08G 1/08 340/907
(Continued)

FOREIGN PATENT DOCUMENTS

JP 2001-134893 A 5/2001
JP 2002-230686 A 8/2002
(Continued)

OTHER PUBLICATIONS

Teruyuki Tajima, et al., "Development and Verification Experiment of Next Generation Signal Control Method", SEI Technical Review, Mar. 2004, vol. 166, pp. 51-55.
(Continued)

*Primary Examiner* — Daniel Previl
(74) *Attorney, Agent, or Firm* — Drinker Biddle & Reath LLP

(57) ABSTRACT

A central device 4 includes: a measurement processing unit 410 that acquires an inflow traffic volume at a first intersection Ci-1; an estimation processing unit 411 that estimates an inflow traffic volume at a second intersection Ci-2 on the basis of at least one of the inflow traffic volume at the first intersection Ci-1 and probe data obtained from a traveling vehicle 5; a control processing unit 412 that generates signal control parameters for the first intersection Ci-1 on the basis of the inflow traffic volume at the first intersection Ci-1, and generates signal control parameters for the second intersection Ci-2 on the basis of the estimated inflow traffic volume at the second intersection Ci-2; and a communication unit
(Continued)

403 that transmits the generated signal control parameters for the first intersection Ci-1 to a traffic signal controller 1*a* at the first intersection Ci-1, and transmits the generated signal control parameters for the second intersection Ci-2 to a traffic signal controller 1*a* at the second intersection Ci-2.

9 Claims, 13 Drawing Sheets

(51) Int. Cl.
*G08G 1/01* (2006.01)
*G08G 1/08* (2006.01)

(52) U.S. Cl.
CPC ..... *G08G 1/0116* (2013.01); *G08G 1/0145* (2013.01); *G08G 1/08* (2013.01)

(58) Field of Classification Search
CPC .... G08G 1/0112; G08G 1/0116; G08G 1/012; G08G 1/08; G08G 1/01; H04W 52/12; H04W 52/143; H04W 52/40; H04L 41/0896; H04L 41/05
USPC ..... 340/910, 911, 907, 909, 933, 917, 916, 340/901–905, 913–915, 926, 918–920, 340/931, 995.13, 995.2
See application file for complete search history.

(56) References Cited

U.S. PATENT DOCUMENTS

2006/0095199 A1* 5/2006 Lagassey ..... G07C 5/008 701/117
2010/0145587 A1* 6/2010 Son ..... G08G 1/096716 701/70
2012/0112928 A1* 5/2012 Nishimura ..... G08G 1/07 340/909
2014/0320316 A1* 10/2014 Peri ..... G08G 1/08 340/907

FOREIGN PATENT DOCUMENTS

JP 2007-122584 A 5/2007
JP 2010-079327 A 4/2010
JP 2011-081640 A 4/2011

OTHER PUBLICATIONS

"Manual on Traffic Signal Control, Revised Edition", edited and issued by Japan Society of Traffic Engineers, Jul. 2006, pp. 16-18 and 83-87.

* cited by examiner

FIG. 9

(a)

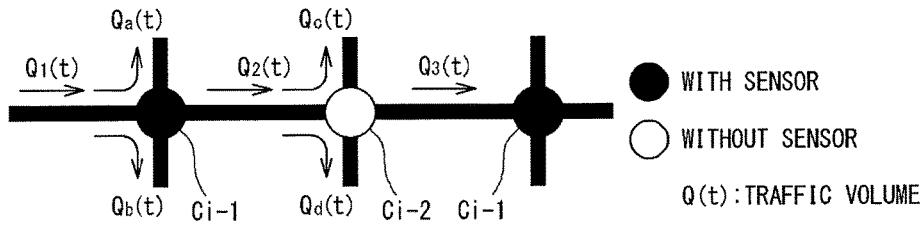

(b)

・INDICATING TRAFFIC VOLUME AT EACH INTERSECTION $$Q_1(t)=Q_2(t+1)+Q_a(t)+Q_b(t) \quad \cdots (5)$$

$$Q_2(t)=Q_1(t-1)+Q_a(t-1)+Q_d(t-1) \approx k(t)Q_1(t-1) \quad \cdots (6)$$

$$Q_2(t)=Q_3(t+1)+Q_c(t)+Q_d(t) \approx h(t)Q_3(t-1) \quad \cdots (7)$$

$$k(t)=\begin{cases} 0.7\ (3\text{p.m}\sim 8\text{p.m}) \\ 0.8\ (6\text{a.m}\sim 10\text{a.m}) \\ 0.9\ \begin{pmatrix} 0\text{a.m}\sim 6\text{a.m} \\ 10\text{a.m}\sim 3\text{p.m} \\ 8\text{p.m}\sim 0\text{a.m} \end{pmatrix} \end{cases} \qquad h(t)=\begin{cases} 0.4\ (3\text{p.m}\sim 8\text{p.m}) \\ 0.8\ (6\text{a.m}\sim 10\text{a.m}) \\ 0.6\ \begin{pmatrix} 0\text{a.m}\sim 6\text{a.m} \\ 10\text{a.m}\sim 3\text{p.m} \\ 8\text{p.m}\sim 0\text{a.m} \end{pmatrix} \end{cases}$$

TRAFFIC SIGNAL CONTROL APPARATUS, TRAFFIC SIGNAL CONTROL METHOD, AND COMPUTER PROGRAM

TECHNICAL FIELD

The present invention relates to a traffic signal control apparatus, a traffic signal control method, and a computer program for controlling signal light colors of traffic signal units on the basis of traffic volumes.

BACKGROUND ART

When conventional traffic signal control methods based on coordinated control and wide-area control are roughly classified in terms of methods for setting signal control parameters (split, cycle length, offset, etc.), there are two types of control methods, i.e., fixed-time control in which signal control parameters are set according to time zones, and traffic actuated control in which signal control parameters are set according to traffic conditions.

Of the above control methods, the traffic actuated control is classified into: terminal actuated control performed for each of traffic signal controllers of terminals; and central actuated control in which signal control parameters are changed over a plurality of intersections that are subjected to route coordinated control or area control.

The above-mentioned central actuated control enables advanced coordinated control and wide-area control (area control) adaptive to change in traffic flow, and therefore is applied to a road on which change in traffic volume over time is considerable, traffic is heavy, and high traffic managing efficiency is required. For example, control methods such as MODERATO (Management by Origin-Destination Related Adaptation for Traffic Optimization) control (refer to Non-Patent Literature 1), and UTMS (Universal Traffic Management Systems) control (refer to Non-Patent Literature 2) are adopted.

CITATION LIST

Non Patent Literature

NON PATENT LITERATURE 1: "Manual on Traffic Signal Control, Revised Edition", edited and issued by Japan Society of Traffic Engineers (pages 16 to 18 and 83 to 87)

NON PATENT LITERATURE 2: "Development and Verification Experiment of Next Generation Signal Control Method", SEI Technical Review, March 2004, Vol. 166, pages 51 to 55

SUMMARY OF INVENTION

Technical Problem

In the above-mentioned signal control methods, an inflow traffic volume to an intersection, which is used to obtain signal control parameters, is usually acquired by a vehicle detector or the like installed on a road.

The vehicle detector is desired to be installed at each of a plurality of intersections to be controlled. However, there are cases where intersections where vehicle detectors are not installed are mixed among the intersections to be controlled, depending on factors such as costs, locational conditions, or the like.

Regarding signal control for an intersection where a vehicle detector is not installed, an inflow traffic volume cannot be acquired, and signal control parameters at this intersection cannot be obtained on the basis of an inflow traffic volume at the present time.

Therefore, signal control may not be appropriately performed at the intersection where a vehicle detector is not installed.

As described above, if some intersections, at which inflow traffic volumes are not obtained and signal control cannot be appropriately performed, are present among the plurality of intersections as control targets, efficiency of traffic management in the entire area to be controlled, including the plurality of intersections as control targets, may be degraded.

In consideration of the above circumstances, an objective of the present invention is to provide a technology capable of improving efficiency of traffic management in the entire area to be controlled.

Solution to Problem

A traffic signal control apparatus according to one embodiment includes: an acquisition unit configured to acquire an inflow traffic volume at a first intersection defined below; an estimation unit configured to estimate an inflow traffic volume at a second intersection defined below, on the basis of at least one of the acquired inflow traffic volume at the first intersection and probe data acquired from a traveling vehicle; an information processing unit configured to generate a signal control parameter for a first controller defined below, on the basis of the acquired inflow traffic volume at the first intersection, and generate a signal control parameter for a second controller defined below, on the basis of the estimated inflow traffic volume at the second intersection; and a communication unit configured to transmit the generated signal control parameter for the first controller to the first controller, and to transmit the generated signal control parameter for the second controller to the second controller.

First intersection: an intersection at which an inflow traffic volume can be obtained;

Second intersection: an intersection at which an inflow traffic volume cannot be obtained;

First controller: a traffic signal controller installed at the first intersection; and Second controller: a traffic signal controller installed at the second intersection.

A traffic signal control method according to one embodiment includes: acquiring an inflow traffic volume at a first intersection defined below; estimating an inflow traffic volume at a second intersection defined below, on the basis of at least one of the acquired inflow traffic volume at the first intersection and probe data acquired from a traveling vehicle; generating a signal control parameter for a first controller defined below, on the basis of the acquired inflow traffic volume at the first intersection, and generating a signal control parameter for a second controller defined below, on the basis of the estimated inflow traffic volume at the second intersection; and transmitting the generated signal control parameter for the first controller to the first controller, and transmitting the generated signal control parameter for the second controller to the second controller.

First intersection: an intersection at which an inflow traffic volume can be obtained;

Second intersection: an intersection at which an inflow traffic volume cannot be obtained;

First controller: a traffic signal controller installed at the first intersection; and Second controller: a traffic signal controller installed at the second intersection.

A computer program according to one embodiment is a computer program for causing a computer to function as the traffic signal control apparatus described above.

Advantageous Effects of Invention

According to the present invention, efficiency of traffic management in an entire area to be controlled can be improved.

(a) of FIG. 9 is a diagram for explaining a method for estimating an inflow traffic volume at a second intersection adjacent to a first intersection, and shows the modes of the intersections, and (b) of FIG. 9 shows mathematical expressions used for estimating the inflow traffic volume.

Figure 10:
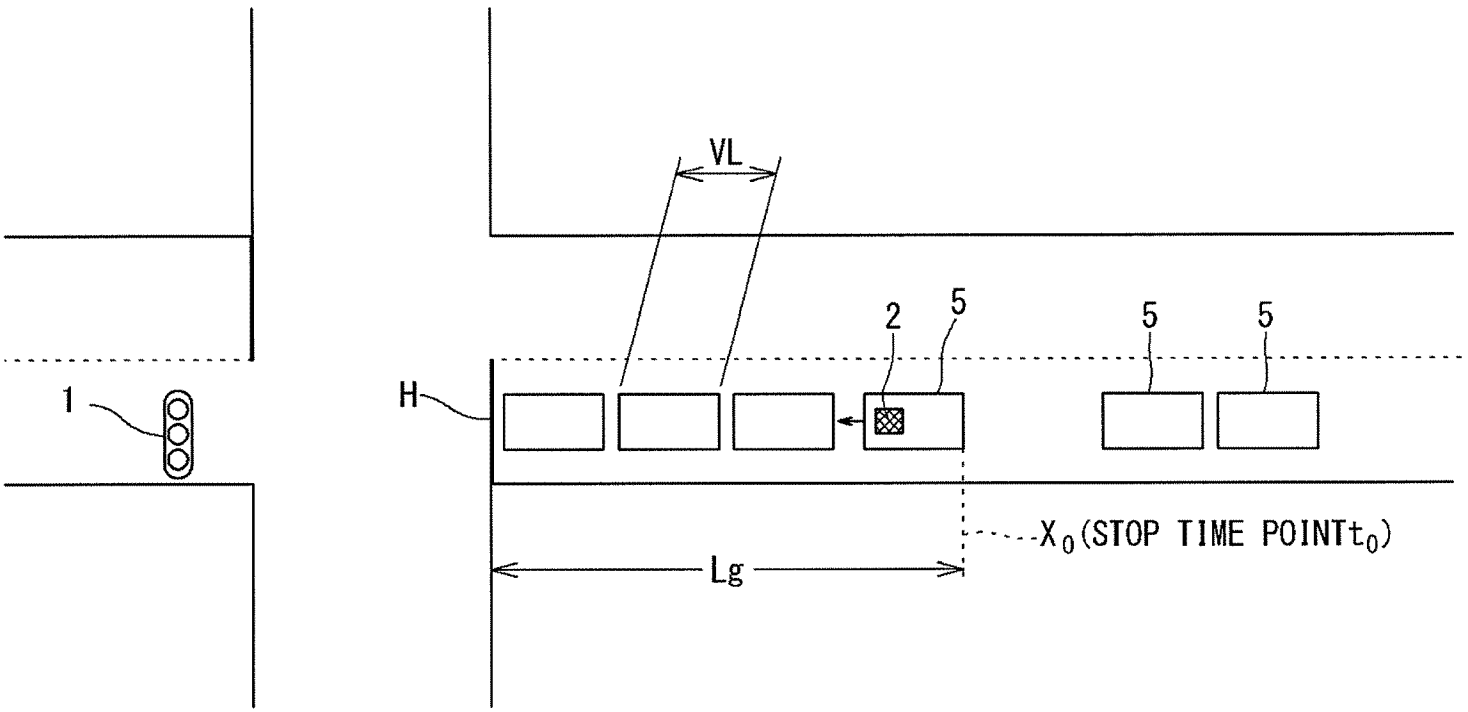

FIG. 10 is a diagram for explaining a method for estimating a queue length at a second intersection by an estimation processing unit of the central device.

Figure 11:
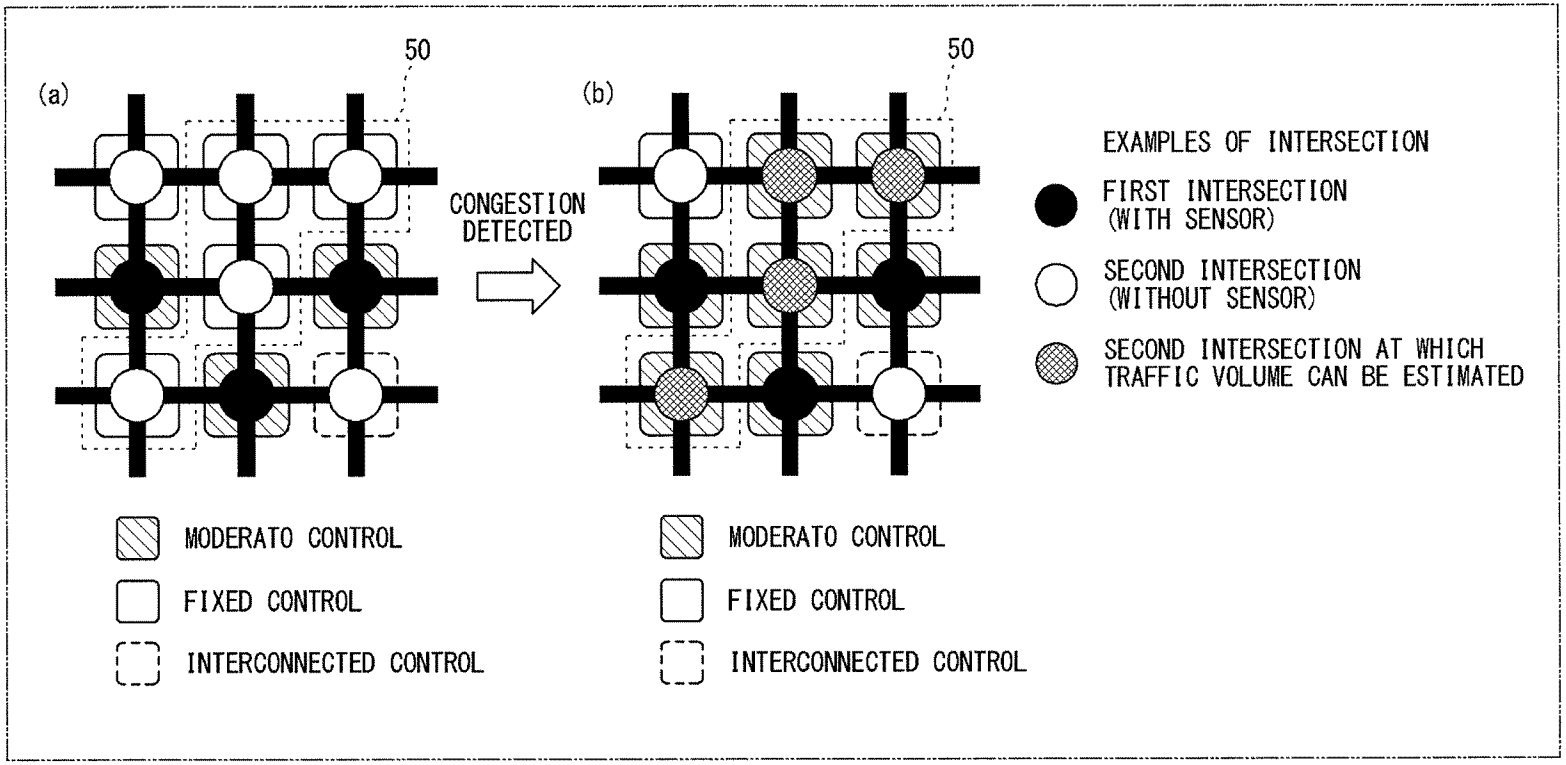

(a) of FIG. 11 is a diagram showing an example of signal control by the central device, and shows a control area where congestion does not occur, and (b) of FIG. 11 shows a case where the control area shown in (a) of FIG. 11 is under congestion.

Figure 12:
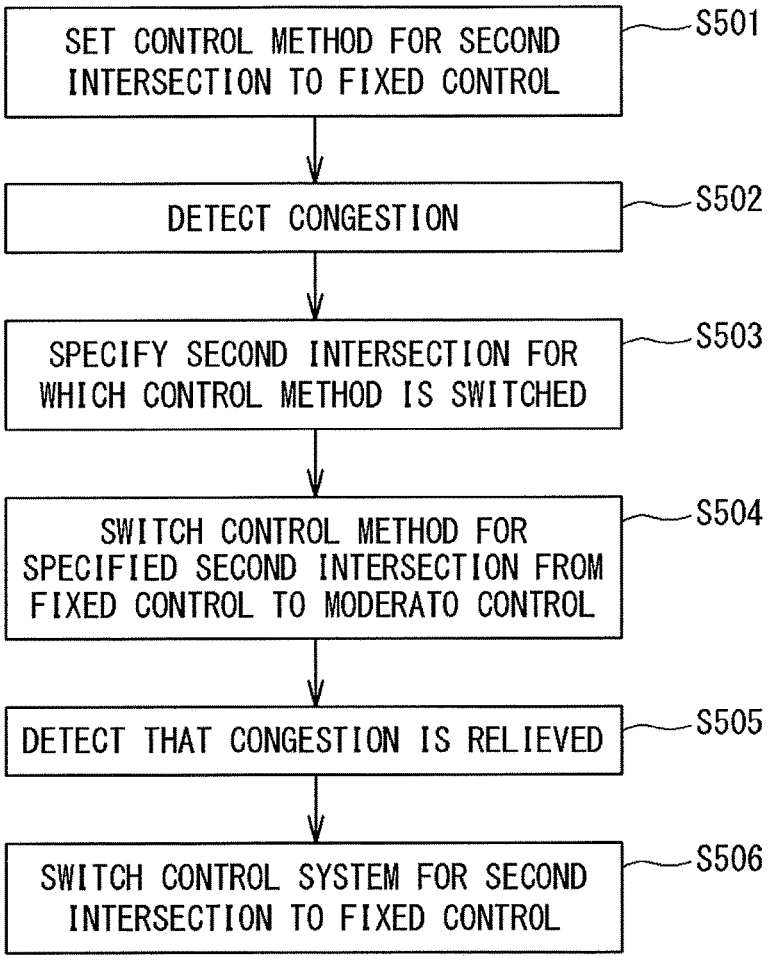

FIG. 12 is a flowchart showing a process procedure shown in FIG. 10.

Figure 13:
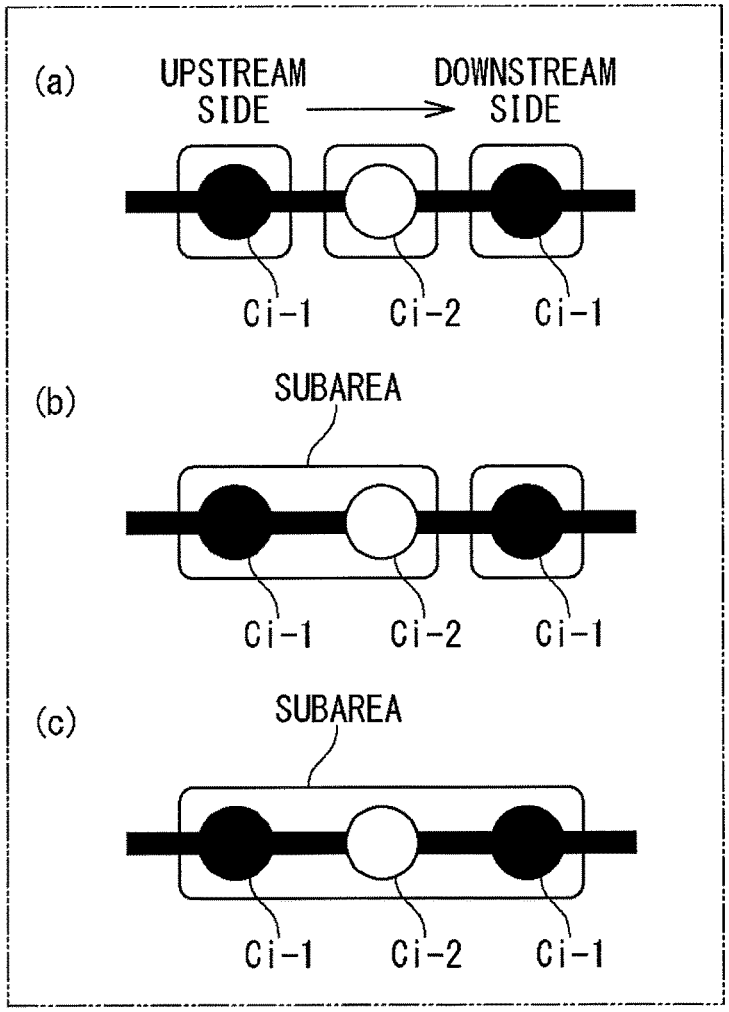

(a) of FIG. 13 is a diagram for explaining a control mode relating to signal control at each intersection according to a modification, and shows a subarea structure when congestion does not occur at both first intersections Ci-1, (b) of FIG. 13 is a diagram showing an example of a subarea structure when congestion is detected, according to the above modification, and (c) of FIG. 13 is a diagram showing another example of a subarea structure when congestion is detected, according to the above modification.

DESCRIPTION OF EMBODIMENTS

Description of Embodiments of the Present Invention

First, contents of embodiments will be listed for description.

(1) A traffic signal control apparatus according to one embodiment includes: an acquisition unit configured to acquire an inflow traffic volume at a first intersection defined below; an estimation unit configured to estimate an inflow traffic volume at a second intersection defined below, on the basis of at least one of the acquired inflow traffic volume at the first intersection and probe data acquired from a traveling vehicle; an information processing unit configured to generate a signal control parameter for a first controller defined below, on the basis of the acquired inflow traffic volume at the first intersection, and generate a signal control parameter for a second controller defined below, on the basis of the estimated inflow traffic volume at the second intersection; and a communication unit configured to transmit the generated signal control parameter for the first controller to the first controller, and to transmit the generated signal control parameter for the second controller to the second controller.

First intersection: an intersection at which an inflow traffic volume can be obtained;

Second intersection: an intersection at which an inflow traffic volume cannot be obtained;

First controller: a traffic signal controller installed at the first intersection; and Second controller: a traffic signal controller installed at the second intersection.

According to the traffic signal control apparatus configured as described above, the estimation unit estimates the inflow traffic volume at the second intersection on the basis of the inflow traffic volume at the first intersection. Therefore, even when the inflow traffic volume at the second intersection cannot be obtained, the signal control parameter for the second controller can be generated on the basis of the inflow traffic volume estimated by the estimation unit. Thus, signal control at the second intersection can be appropriately performed.

As a result, even when an intersection at which no inflow traffic volume can be obtained is present, signal control can be appropriately performed at each intersection. Thus, it is possible to improve efficiency of traffic management in an entire area to be controlled, including a plurality of intersections as control targets.

(2) In the above-described traffic signal control apparatus, two control methods defined below may be provided as switchable control methods to be performed on the second controller by the information processing unit.

Actuated method: a control method in which the signal control parameter for the second controller is generated on the basis of the estimated inflow traffic volume at the second intersection; and Non-actuated method: a control method in which a preset signal control parameter or a signal control parameter being applied to an adjacent first controller is adopted as the signal control parameter for the second controller.

(3) In the above-described case, the information processing unit is capable of determining whether or not the first intersection is under congestion, on the basis of the inflow traffic volume at the first intersection. The information processing unit may adopt the actuated method as the control method of the second controller in the case where the first intersection is under congestion, and adopt the non-actuated method as the control method of the second controller in the case where the first intersection in not under congestion.

Thus, an appropriate signal control method can be selected in accordance with the traffic condition.

(4) (5) In the above-described traffic signal control apparatus, the information processing unit is capable of executing a subarea connection determination process of determining, on the basis of a traffic condition, whether or not a plurality of intersections adjacent to each other should be included in the same subarea. In the determination process, the information processing unit preferably treats the second intersection equally to the first intersection in the case where a predetermined condition is satisfied, and does not regard the second intersection as a target of subarea connection in the case where the predetermined condition is not satisfied. In this case, the predetermined condition is preferably that the first intersection is under congestion.

Thus, a second intersection can be included in the same subarea as a first intersection adjacent to the second intersection, whereby efficiency of traffic management in the area to be controlled can be further improved.

(6) Further, the information processing unit is capable of executing a subarea connection determination process of determining, on the basis of a traffic condition, whether or not a plurality of intersections adjacent to each other should be included in the same subarea. The determination process may include calculating: a first evaluation value obtained from a predetermined evaluation condition in the case where signal control is performed with cycle lengths respectively set at the plurality of intersections adjacent to each other; and a second evaluation value obtained from the predetermined evaluation condition in the case where signal control is performed such that each of the respective cycle lengths of the plurality of intersections adjacent to each other is set to be the same value as a cycle length which is obtained based on reliability indicating a degree of reliability obtained based on a process for obtaining a signal control parameter at each intersection, and determining whether or not the plurality of intersections adjacent to each other should be included in the same subarea, on the basis of comparison between the first evaluation value and the second evaluation value. In this case, the determination can be performed more appropriately.

(7) A signal control method according to one embodiment includes: acquiring an inflow traffic volume at a first intersection defined below; estimating an inflow traffic volume at a second intersection defined below, on the basis of at least one of the acquired inflow traffic volume at the first intersection and probe data acquired from a traveling vehicle; generating a signal control parameter for a first controller defined below, on the basis of the acquired inflow traffic volume at the first intersection, and generating a signal control parameter for a second controller defined below, on the basis of the estimated inflow traffic volume at the second intersection; and transmitting the generated signal control parameter for the first controller to the first controller, and transmitting the generated signal control parameter for the second controller to the second controller.

First intersection: an intersection at which an inflow traffic volume can be obtained;

Second intersection: an intersection at which an inflow traffic volume cannot be obtained;

First controller: a traffic signal controller installed at the first intersection; and Second controller: a traffic signal controller installed at the second intersection.

(8) A computer program according to one embodiment is a computer program for causing a computer to function as the traffic signal control apparatus described in above (1).

DETAILED DESCRIPTION OF EMBODIMENTS OF THE PRESENT INVENTION

Hereinafter, preferable embodiments will be described with reference to the drawings.

1. Definition of Terms

In advance of specifically describing the embodiments, terms used in this specification will be defined below.

A "first intersection" is an intersection where a road side sensor such as a vehicle detector is installed, and an inflow traffic volume as a traffic volume in its inflow path can be obtained.

A "second intersection" is an intersection where a road side sensor such as a vehicle detector is not installed and therefore an inflow traffic volume cannot be obtained.

A "first controller" is a traffic signal controller that is installed at the first intersection, and performs signal control for a traffic signal unit installed at the first intersection.

A "second controller" is a traffic signal controller that is installed at the second intersection, and performs signal control for a traffic signal unit installed at the second intersection.

A "vehicle" is a general vehicle that travels on a road, specifically, a vehicle according to the Road Traffic Law. Vehicles according to the Road Traffic Law include automobiles, motorbikes, light vehicles, and trolley buses. In the present embodiment, when simply mentioning a "vehicle", this vehicle means both a probe vehicle including an on-vehicle device capable of transmitting probe data, and an ordinary vehicle that does not include such an on-vehicle device.

A "vehicle detector" is a road side sensor that detects presence of vehicles traveling on a road, one by one, at a fixed position. Examples of the vehicle detector include: an ultrasonic vehicle detector that ultrasonically detects a vehicle traveling directly below the detector; a thermal vehicle detector that detects passage of a vehicle by a temperature change when the vehicle passes; a loop coil that is embedded in a road and detects a vehicle by an inductance change; and the like.

A "detected signal" is a pulse signal that is outputted from a vehicle detector installed at a predetermined position on a road when the vehicle detector detects one vehicle. Therefore, when a plurality of vehicles pass the vehicle detector, detecting signals corresponding to the respective vehicles are outputted in chronological order.

"Probe data" is various types of information relating to a probe vehicle, which is obtained from an on-vehicle device of the probe vehicle actually traveling on a road. The probe data is sometimes referred to as probe data or floating car data. The probe data includes data such as the vehicle ID, the vehicle position, the vehicle speed, the vehicle azimuth, and the times at which these occur.

Since the vehicle speed can be calculated based on the vehicle position and the time, it suffices that the probe data includes the vehicle position and the time that are measured at each predetermined period (e.g., 1 sec). Of course, the probe data may include the vehicle speed at each time.

"Signal control parameters" generally include a cycle length, a split, and an offset. In the present embodiment, timing to switch a light color of a signal light at an intersection (start time of each light color, display time thereof, and the like) is included.

In the present embodiment, since probe data of a probe vehicle that has passed an intersection in a time zone of green is used for calculation of link travel time, the switching timing of the signal light color includes time information (start time and display time, or start time and end time) that can specify the start and end of the time zone of green.

A "cycle length" is time for one cycle from the start time of green (or red) of a traffic signal unit to the next start time of green (or red).

A "split" is a ratio of time (green signal time, red signal time, or the like) assigned to each aspect, to the cycle length.

An "offset" is a deviation in green signal start time between adjacent intersections. An offset is represented by a percentage to the time of one cycle or by seconds.

A "queue" is a line of vehicles that stop before an intersection, waiting for the signal light to change from red to green, for example.

"Congestion at an intersection" is a situation that a queue that occurs before an intersection cannot be cleared within a single green signal interval. Therefore, if a signal queue at an intersection is cleared within a single green signal interval, no "congestion" occurs at this intersection.

Also when a queue length greater than or equal to a predetermined value is not measured, it may be determined that no "congestion" occurs.

A "road section" is a section from an optional point on a road to another optional point on the road. In the present embodiment, as a road section for which estimated travel time generated from the probe data is calculated, a "link" as follows is assumed.

A "link" is a road section that has an upward or downward direction, and connects nodes such as intersections.

When viewed from a certain intersection, a link in an inflow direction toward this intersection is referred to as an inflow link. When viewed from a certain intersection, a link in an outflow direction from this intersection is referred to as an outflow link.

A "node" is a nodal point in road terminology, such as an intersection, a point at which an attribute such as a road type changes, or the like.

A "route" is a road section including a plurality of coordinated sections. Between adjacent coordinated sections, a boundary link that is not subjected to coordinated control is included.

A "coordinated section" is a road section to be subjected to the later-described coordinated control. The coordinated section includes about 3 to 5 links.

A "subarea" is an area divided so as to include one or a plurality of intersections at which a traffic signal unit subjected to signal control with a common cycle length is installed.

"Traffic progressive control" is control in which an offset in traffic signal units between intersections included in a series of coordinated sections set in a subarea is adjusted, whereby a vehicle is allowed to easily pass, at green signals, in a specific direction of the coordinated sections (priority offset) or conversely, a vehicle is allowed to easily and safely stop at red signals.

2. Overall Configuration of System

Figure 1:
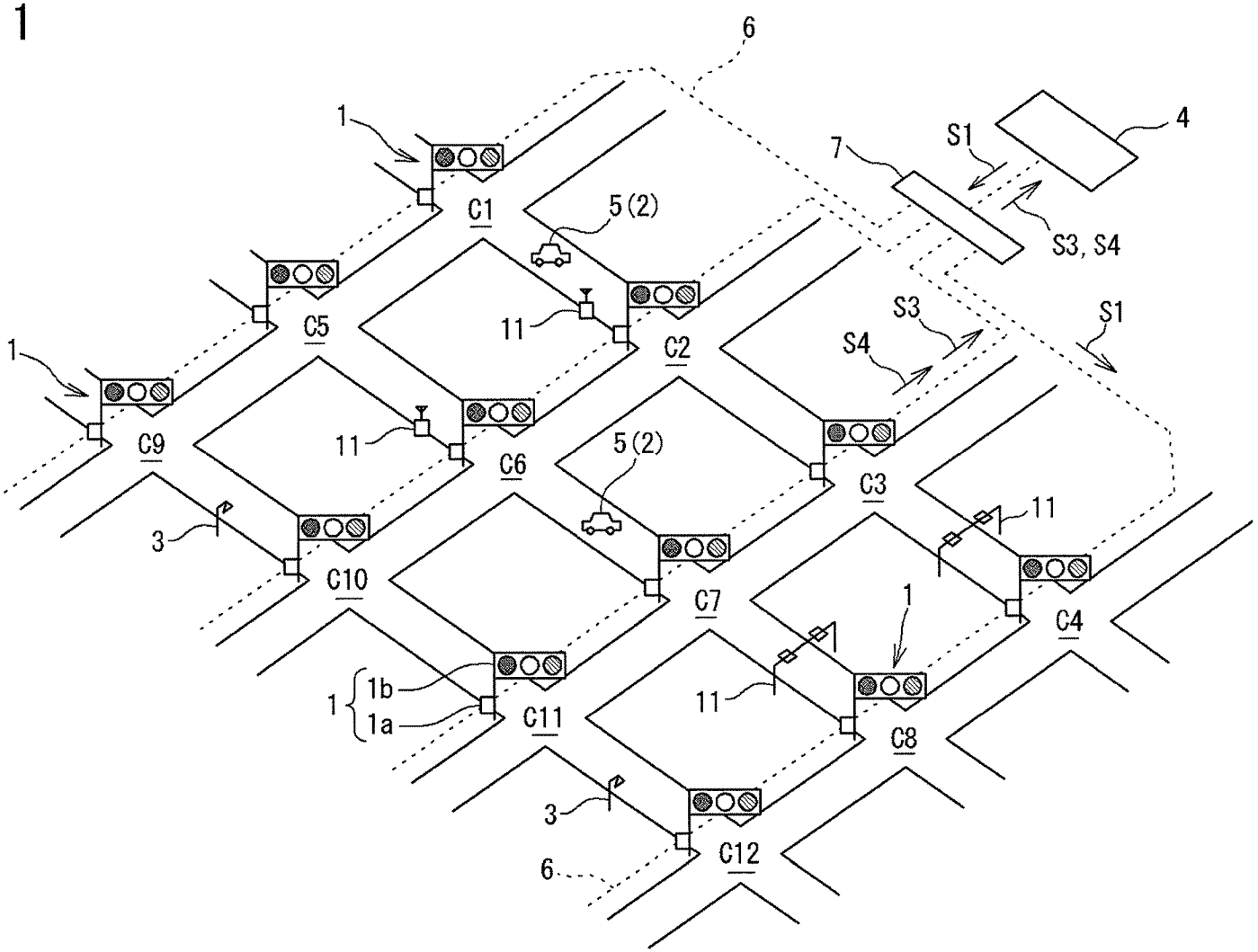
FIG. 1 is a diagram showing an overall configuration of a traffic signal control system.
Figure 2:
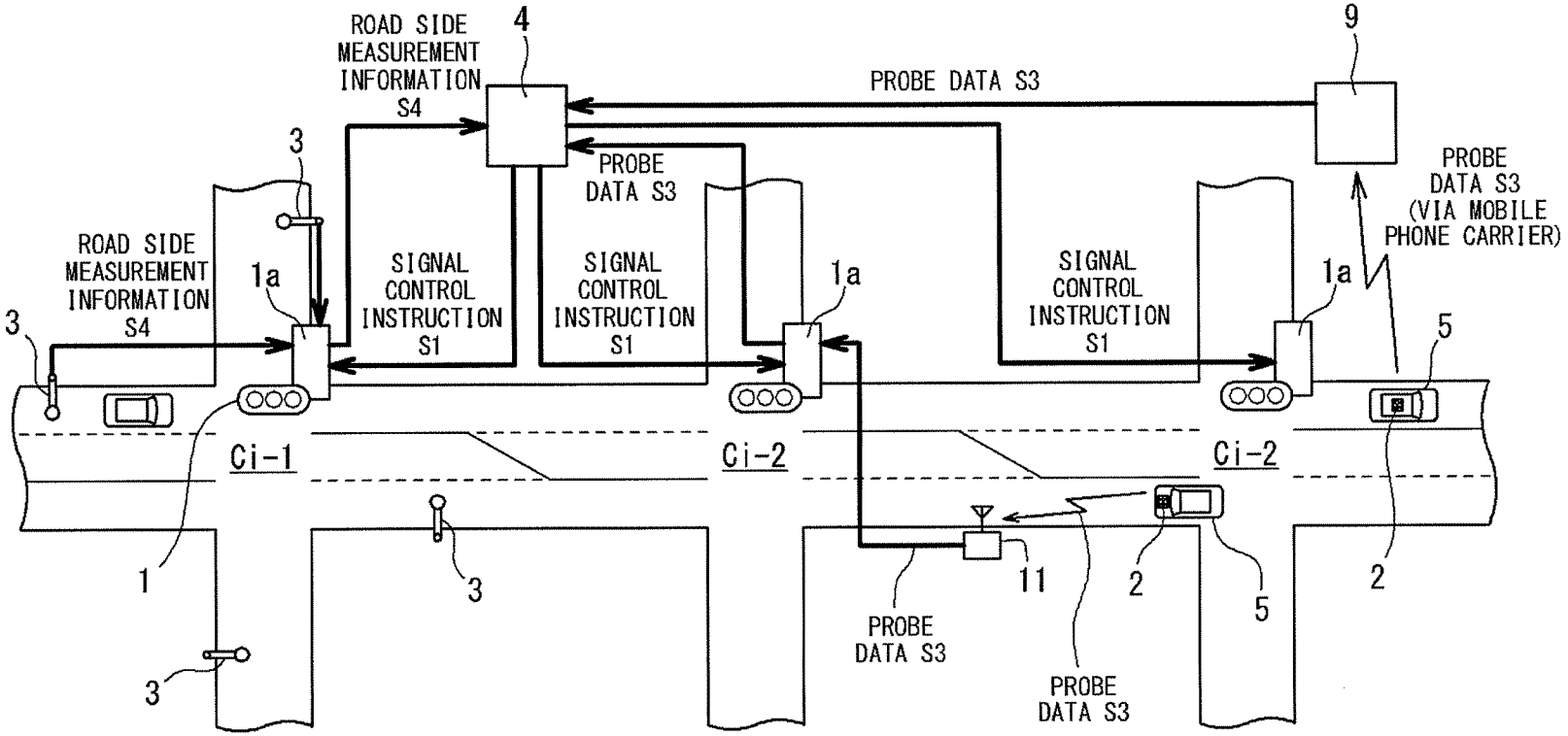
FIG. 2 is a diagram showing a configuration of the traffic signal control system, and a flow of exchange of information in this system.

FIG. 1 is a diagram showing an overall configuration of the traffic signal control system. FIG. 2 is a diagram showing a configuration of the traffic signal control system, and a flow of exchange of information in this system.

As shown in FIG. 1 and FIG. 2, the traffic signal control system according to the present embodiment includes: traffic signal units 1; on-vehicle wireless devices 2; road side sensors 3 such as vehicle detectors; a central device 4, vehicles 5 each equipped with an on-vehicle wireless device 2; a probe data management device 9; road side wireless devices 11 installed on a road; and the like.

In FIG. 1 and FIG. 2, S1 denotes a signal control instruction for controlling timing to switch a signal light color of each traffic signal unit 1. The signal control instruction is generated by the central device 4.

S3 denotes probe data generated by each vehicle (probe vehicle) 5 equipped with the on-vehicle wireless device 2, and the probe data S3 includes the position, the speed, the time, and the like of a traveling vehicle 5 at each predetermined period or distance.

S4 denotes road side measurement information measured by each road side sensor 3 (e.g., the number of vehicles 5 that have passed the road side sensor 3).

In the traffic signal control system shown in FIG. 1, each traffic signal unit 1 is installed at each of a plurality of intersections Ci (i=1 to 12), and is connected to a router 7 through a communication line 6 such as a telephone line or a wireless communication line.

The router 7 is connected to the central device 4 in a traffic control center, and the central device 4 constitutes a LAN (Local Area Network) with traffic signal controllers 1*a* at the intersections Ci included in a control area managed by the central device 4.

Therefore, the central device 4 is capable of bidirectional communication with each traffic signal controller 1*a*, and each traffic signal controller 1*a* is capable of bidirectional communication with other traffic signal controllers 1*a*. The central device 4 may be installed not in the traffic control center but on a road.

In FIG. 1, in order to simplify the drawing, only one signal light unit 1*b* is drawn at each intersection Ci. However, in an actual intersection Ci, four signal light units 1*b* are installed for up and down lanes of intersecting roads.

Each road side sensor 3 is composed of, for example, a vehicle detector that ultrasonically detects a vehicle 5 traveling directly below the detector, a loop coil that detects a vehicle 5 by an inductance change, or an image sensor that processes an image captured by a camera to measure the traffic volume or the vehicle speed.

As shown in FIG. 2, the road side sensor 3 is installed on the upstream side of each of roads extending from the corresponding intersection Ci. The road side sensor 3 is provided for some intersections Ci among the intersections included in the control area, and measures the number of vehicles flowing into the intersection Ci (inflow traffic volume), and the speed of each vehicle.

Therefore, in the control area in the system according to the present embodiment, as shown in FIG. 2, an intersection Ci (hereinafter also referred to as "first intersection Ci-1") in which the road side sensor 3 is installed and an inflow traffic volume can be obtained and an intersection Ci (hereinafter also referred to as "second intersection Ci-2") in which the road side sensor 3 is not installed and an inflow traffic volume cannot not obtained, are mixed.

The road side sensor 3 is communicably connected to the traffic signal controller 1*a* through a wired or wireless communication line. The road side sensor 3 outputs the result of detection as road side measurement information S4. The road side measurement info' nation S4 is outputted from the road side sensor 3 as information with which the number of passing vehicles 5 per unit time, the speed of each vehicle, and the like can be estimated, and is relayed at the traffic signal controller 1*a* to be transferred to the central device 4.

As shown in FIG. 2, the road side wireless device 11 is installed at each intersection Ci.

The road side wireless device 11 is capable of bidirectional communication with the traffic signal controller 1*a* through a wired or wireless communication line.

The road side wireless device 11 has a function of performing wireless communication by Wi-Fi (Registered Trademark) or the like with the on-vehicle wireless device 2 of each vehicle 5 traveling therearound.

The road side wireless device 11 transfers, to the on-vehicle wireless device 2, various kinds of information provided from the central device 4 through the traffic signal controller 1*a*.

The road side wireless device 11 receives probe data S3 transmitted from the on-vehicle wireless device 2. The received probe data S3 is relayed at the traffic signal controller 1*a* and transferred to the central device 4.

In this case, the on-vehicle wireless device 2 is connected by wireless communication with the road side wireless device 11, and therefore can transmit, in real time, the probe data S3 generated by the on-vehicle wireless device 2.

As shown in FIG. 2, the on-vehicle wireless device 2 may be configured to have a function of performing wireless communication by Wi-Fi (Registered Trademark) with the road side wireless device 11, or may be configured as a mobile phone such as a smart phone.

When the on-vehicle wireless device 2 is configured as a mobile phone, the road side wireless device 11 can collect the probe data S3 through a communication line of the mobile phone.

The road side wireless device 11 includes the probe data management device 9 for collecting the probe data S3 that is transmitted from the on-vehicle wireless device 2 configured as a mobile phone through a wireless communication line of the mobile phone. The probe data management device 9 acquires the probe data S3 that is transmitted by the on-vehicle wireless device 2 configured as a mobile phone through the communication line of the mobile phone, via a carrier of the mobile phone constituting the on-vehicle wireless device 2, for example, and provides the probe data S3 to the central device 4.

Thus, the central device 4 according to the present embodiment can acquire, in addition to the probe data S3 collected by the road side wireless device 11, the probe data S3 collected through the communication line of the mobile phone. The on-vehicle wireless device 2 can transmit the probe data S3 that had been acquired and accumulated during a period of time in the past, or can transmit the probe data S3 of the device 2 in real time, depending on the configuration of the device 2.

3. Central Device

Figure 3:
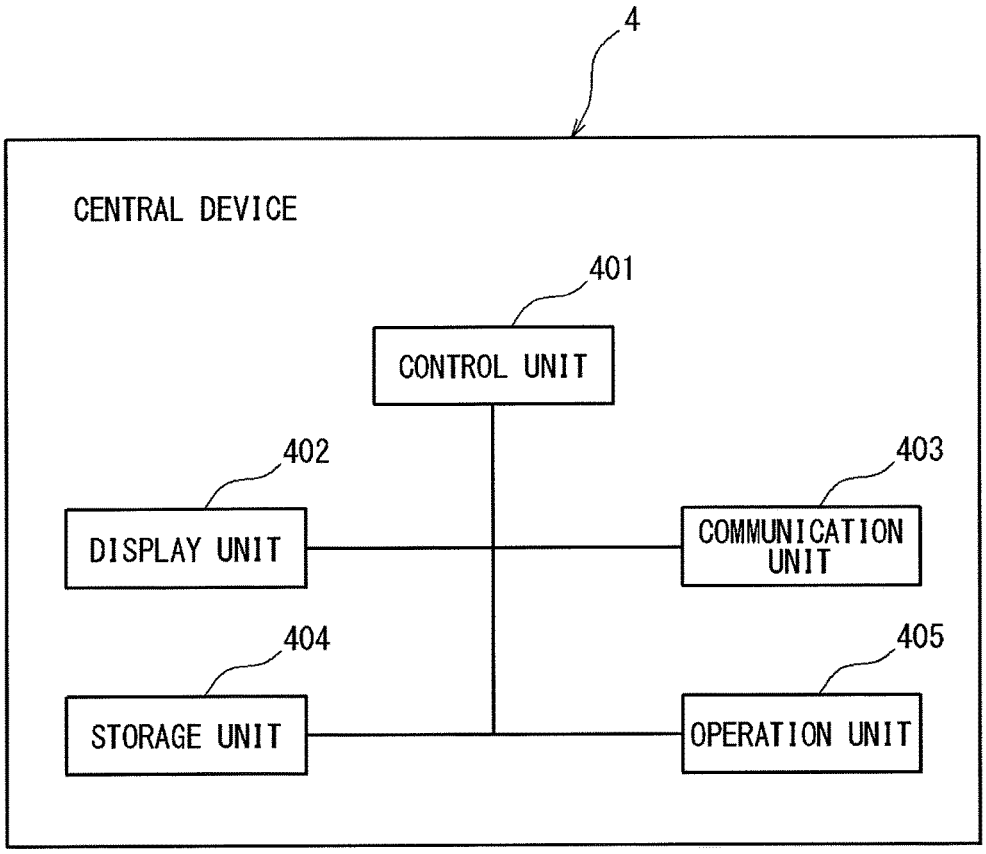
FIG. 3 is a functional block diagram showing an internal configuration of a central device.

FIG. 3 is a functional block diagram showing the internal configuration of the central device 4.

As shown in FIG. 3, the central device 4 includes a control unit 401, a display unit 402, a communication unit 403, a storage unit 404, and an operation unit 405.

The control unit 401 of the central device 4 is composed of a workstation (WS), a personal computer (PC), or the like, and comprehensively performs: collection, processing (calculation), and recording of various kinds of measurement information acquired from the traffic signal controller 1*a*, the road side sensor 3 and the like; signal control; and provision of information. The control unit 401 is connected to the above-mentioned hardware components via an internal bus, and also controls the operations of these components.

The communication unit 403 of the central device 4 is a communication interface connected to the LAN side via the communication line 6, and transmits, at each predetermined period, a signal control instruction S1 relating to light color switching timing of the signal light unit 1*b*, to each traffic signal controller 1*a*.

That is, the central device 4 transmits the signal control instruction S1 to each traffic signal controller 1*a*, thereby configuring a traffic signal control apparatus that controls each traffic signal controller 1*a*.

The signal control instruction S1 is transmitted in each calculation cycle (e.g., 1.0 to 2.5 min) of signal control parameters.

The communication unit 403 may transmit signal control parameters as a signal control instruction S1 to each traffic signal controller 1*a*. In this case, each traffic signal controller 1*a* performs signal control on the basis of the provided signal control parameters.

The communication unit 403 of the central device 4 receives, from each traffic signal controller 1*a*, the road side measurement information S4 from the road side sensor 3 in real time (e.g., in cycles of 0.1 to 1.0 sec), and receives the probe data S3 provided from each traffic signal controller 1*a* and the probe data management device 9.

The storage unit 404 of the central device 4 is composed of a hard disk, a semiconductor memory, or the like, and has, stored therein, an operating system of the central device 4, a control program for performing the above-mentioned MODERATO control, a calculation program for a predicted traffic volume and a traffic index to be used for this control, and the like.

In addition, the storage unit 404 stores, therein, the road side measurement information S4 provided from each traffic signal controller 1*a*, in association with the corresponding intersection Ci (first intersection Ci-1). Further, the storage unit 404 also stores, therein, an inflow traffic volume (described later) and a queue length (described later) which are obtained from the road side measurement information S4, in association with the corresponding intersection Ci.

In addition, the storage unit 404 also stores, therein, the probe data S3 provided from each traffic signal controller 1*a* and the probe data management device 9.

Further, the storage unit 404 stores, therein, an estimated inflow traffic volume (described later) and an estimated queue length (described later) at the second intersection Ci-2, which are obtained from the inflow traffic volume and the probe data S3 stored in the storage unit 404, in association with the corresponding second intersection Ci-2.

The storage unit 404 temporarily stores, therein, the signal control instruction S1 and the like generated by the control unit 401 to be provided to each traffic signal unit 1.

The display unit 402 of the central device 4 is composed of a display screen on which a road map of the control area managed by the central device 4, and the positions of all the traffic signal units 1, the road side wireless devices 11, and the like on the road map, are displayed. The display unit 402 notifies a central operator of traffic conditions such as congestion and accident.

The operation unit 405 of the central device 4 is composed of an input interface such as a keyboard, a mouse, or the like, and allows the central operator to perform a display switching operation and the like on the display unit 402.

The control unit 401 of the central device 4 executes the above-mentioned various computer programs stored in the storage unit 404, thereby implementing necessary functions, and functional units described later.

Figure 4:
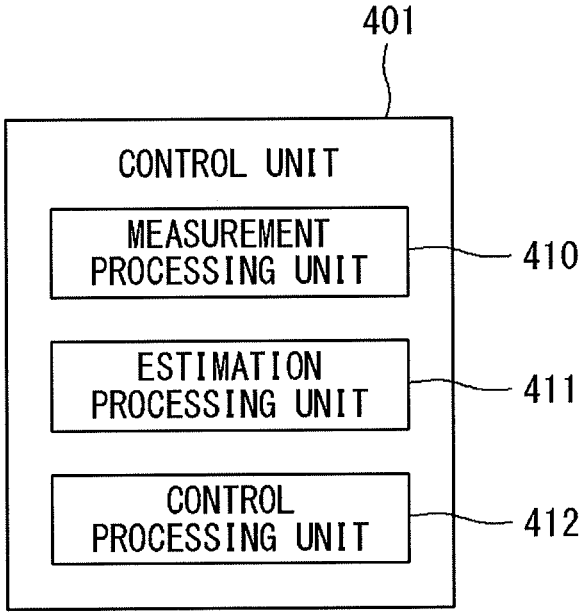
FIG. 4 is a functional block diagram showing functions of a control unit of the central device.

FIG. 4 is a functional block diagram showing the functions of the control unit 401 of the central device 4.

As shown in FIG. 4, the control unit 401 includes a measurement processing unit 410, an estimation processing unit 411, and a control processing unit 412.

The measurement processing unit 410 has a function of receiving, from the respective components, measured information such as the road side measurement information S4 from the road side sensor 3, and the probe data S3 provided from each traffic signal controller 1*a* and the probe data management device 9, and processing these pieces of information.

The measurement processing unit 410 has a function of receiving the road side measurement information S4 from the road side sensor 3, and obtaining an inflow traffic volume at a target intersection Ci on the basis of the road side measurement information S4.

The inflow traffic volume is a value that is based on the road side measurement information S4 measured by the road side sensor 3, and represents a traffic volume flowing into the intersection Ci. In the present embodiment, the inflow traffic volume is represented by the number of passing vehicles 5 per hour.

Since the road side sensor 3 is not installed at each second intersection Ci-2, an inflow traffic volume at the second intersection Ci-2 cannot be obtained. Therefore, the measurement processing unit 410 obtains an inflow traffic volume for only the first intersection Ci-1.

Further, the measurement processing unit 410 obtains a queue length at the target first intersection Ci-1 on the basis of the road side measurement information S4.

The queue length is a value that is based on the road side measurement information S4 measured by the road side sensor 3, and represents the queue length of vehicles that stop before the intersection, waiting for the signal light to change from red to green, for example. In the present embodiment, the queue length is a value represented by the number of vehicles 5.

The measurement processing unit 410 stores, in the storage unit 404, the obtained inflow traffic volume and queue length at each first intersection Ci-1.

The measurement processing unit 410 also has a function of receiving the probe data S3 provided from each traffic signal controller 1*a* and the probe data management device 9, and storing and managing the probe data S3 in the storage unit 404.

The estimation processing unit 411 has a function of estimating an inflow traffic volume at the second intersection Ci-2, on the basis of at least one of the probe data S3 and the inflow traffic volume at the first intersection Ci-1 which is obtained by the measurement processing unit 410.

In addition, the estimation processing unit 411 also has a function of obtaining a queue length at the second intersection Ci-2 on the basis of at least one of the inflow traffic volume at the first intersection Ci-1 and the probe data S3.

The control processing unit 412 performs, on the traffic signal units 1 at the first intersections Ci that belong to its own network, a coordinated control for adjusting a group of the traffic signal units 1 on the same road, and a wide-area control (area control) that is the coordinated control being expanded on a road network. For example, the control processing unit 412 can perform the above-mentioned MODERATO control.

The MODERATO control is a macro control for the traffic signal units 1 that belong to the network 6. In the MODERATO control, in order to cope with a near-saturated traffic condition, most appropriate signal control parameters for each traffic signal unit 1 are generated in each cycle by using a traffic index which is a demand factor.

The demand factor is calculated on the basis of the inflow traffic volume and the queue length.

The control processing unit 412 calculates the demand factor on the basis of the inflow traffic volume and the queue length which are stored in the storage unit 404, and generates signal control parameters from the demand factor.

The control processing unit 412 generates signal control parameters corresponding to each traffic signal controller 1*a*, includes the signal control parameters in the signal control instruction S1, and transmits the signal control instruction S1 to each traffic signal controller 1*a*.

The control processing unit 412 can control each traffic signal controller 1*a* by providing the signal control parameters to the traffic signal controller 1*a*.

The control processing unit 412 according to the present embodiment executes the above-mentioned MODERATO control, for the first intersection Ci-1 at which the inflow traffic volume and the queue length are obtained, which are the values based on the road side measurement information S4 measured by the road side sensor 3.

On the other hand, regarding the second intersection Ci-2 at which the road side sensor 3 is not installed and the inflow traffic volume based on the measured traffic volume cannot be obtained, the control processing unit 412 executes control while switching the control method between the MODERATO control and fixed control.

The content of processing performed by the estimation processing unit 411 and the control processing unit 412 will be described later in detail.

4. Traffic Signal Controller

Figure 5:
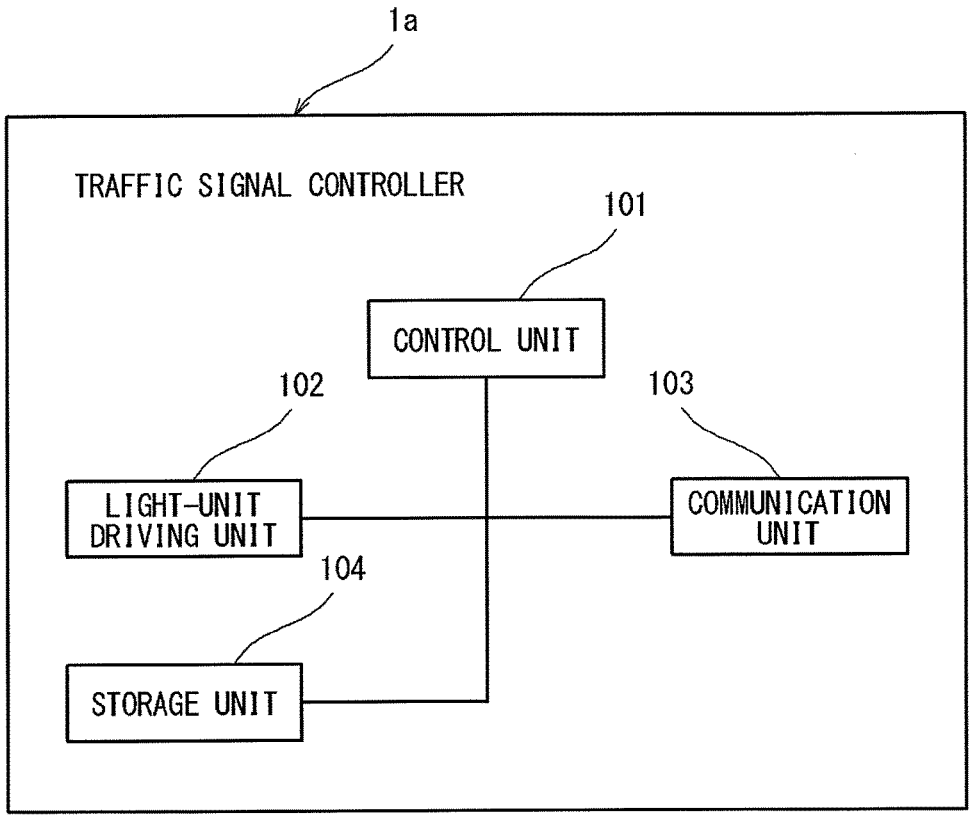
FIG. 5 is a functional block diagram showing an internal configuration of a traffic signal controller.

FIG. 5 is a functional block diagram showing the internal configuration of the traffic signal controller 1*a*.

The traffic signal controller 1*a* receives the signal control instruction S1 from the central device 4, and controls lighting, extinction, and blinking of signal lights, such as green, yellow, red, and right-turn arrow lights, of each signal light unit 1*b* on the basis of the signal control instruction S1.

As shown in FIG. 5, the traffic signal controller 1*a* includes a control unit 101, a light-unit driving unit 102, a communication unit 103, and a storage unit 104.

The control unit 101 of the traffic signal controller 1*a* is composed of one or a plurality of microcomputers. The light-unit driving unit 102, the communication unit 103, and the storage unit 104 are connected to the control unit 101 via an internal bus. The control unit 101 controls the operations of these hardware components.

The control unit 101 drives each signal light unit 1*b* in accordance with the signal control instruction S1 which is an output of results of coordinated control and wide-area control performed by the central device 4, and switches the signal light color of each signal light unit 1*b* at predetermined timing based on the instruction S1.

The light-unit driving unit 102 includes a semiconductor relay (not shown), and turns on and off an AC voltage or a DC voltage supplied to a signal light of each color, in response to each of green lights, yellow lights, and red lights of a plurality of signal light units 1*b*, on the basis of the signal control instruction S1 inputted from the control unit 101.

The communication unit 103 of the traffic signal controller 1*a* is a communication interface that communicates with the central device 4, the road side sensor 3, and the road side wireless device 11.

The communication unit 103 receives the signal control instruction S1 from the central device 4, and provides the instruction S1 to the control unit 101 of the traffic signal controller 1*a*.

In addition, the communication unit 103 receives the road side measurement information S4 from the road side sensor 3, and transfers the information S4 to the central device 4.

Further, upon receiving the probe data S3 from the road side wireless device 11, the communication unit 103 transfers the probe data S3 to the central device 4.

The storage unit 104 of the traffic signal controller 1*a* is composed of a hard disk, a semiconductor memory, or the like. The storage unit 104 stores, therein, a program for switching control of the signal light colors on the basis of the signal control instruction S1, and temporarily stores, therein, various types of information such as the signal control instruction S1 received by the communication unit 103.

5. On-Vehicle Wireless Device

Figure 6:
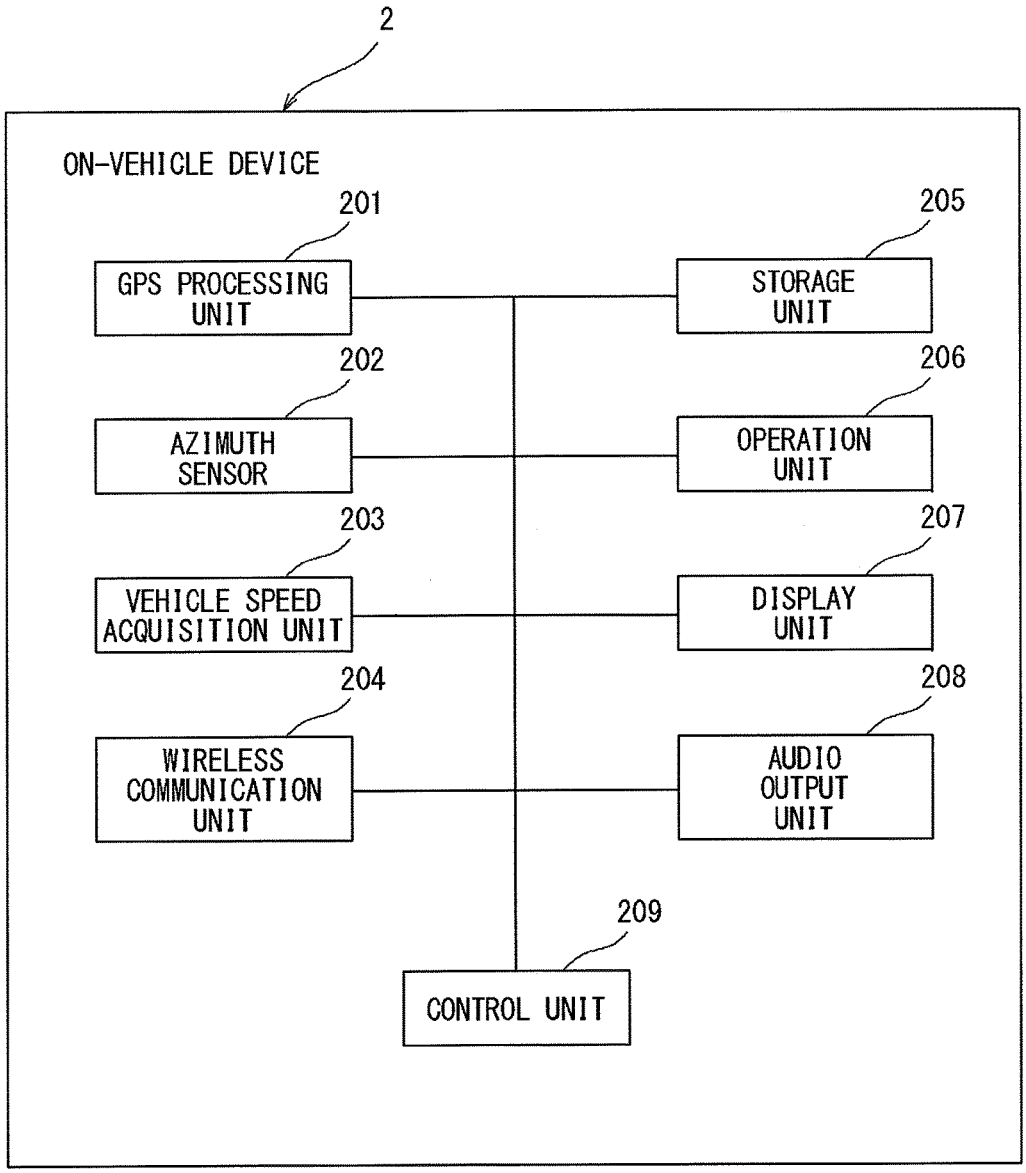
FIG. 6 is a functional block diagram showing an internal configuration of an on-vehicle device.

FIG. 6 is a functional block diagram showing the internal configuration of the on-vehicle wireless device 2.

The on-vehicle wireless device 2 is a device installed in each probe vehicle 5, and has a wireless communication function of performing wireless communication by Wi-Fi (Registered Trademark) with the road side wireless device 11, and a navigation function of guiding the vehicle 5 to a destination set by an occupant.

As shown in FIG. 6, the on-vehicle wireless device 2 includes a GPS processing unit 201, an azimuth sensor 202, a vehicle speed acquisition unit 203, a wireless communication unit 204, a storage unit 205, an operation unit 206, a display unit 207, an audio output unit 208, a control unit 209, and the like.

The GPS processing unit 201 receives a GPS signal from a GPS satellite, and measures the position (latitude, longitude, and altitude) of the probe vehicle 5 on the basis of time information, the orbit of the GPS satellite, positioning correction information, and the like which are included in the GPS signal.

The azimuth sensor 202 is composed of an optical fiber gyro or the like, and measures the azimuth and the angular velocity of the probe vehicle 5. The vehicle speed acquisition unit 203 acquires an output from a vehicle speed sensor of the probe vehicle 5, and acquires speed data of the probe vehicle 5 by obtaining the relationship between the position and the time of the probe vehicle 5 which are obtained from the GPS signal.

The wireless communication unit 204 of the on-vehicle wireless device 2 has a function of performing wireless communication by Wi-Fi (Registered Trademark) with the road side wireless device 11.

That is, when the wireless communication unit 204 of the on-vehicle wireless device 2 enters a communication area in which wireless communication with the road side wireless device 11 is allowed, the wireless communication unit 204 establishes wireless communication with the road side wireless device 11, and transmits its own probe data S3 to the road side wireless device 11 in real time.

The storage unit 205 of the on-vehicle wireless device 2 is composed of a hard disk, a semiconductor memory, or the like, and has a storage area in which the probe data S3 acquired during a period of time in the past is accumulated, and various types of information are stored.

The storage unit 205 also stores road map data therein. The road map data contains intersection data that associates an intersection ID with the position of an intersection.

The operation unit 206 of the on-vehicle wireless device 2 is composed of a touch panel, buttons, and the like, and allows an occupant of the vehicle 5, including a driver, to perform destination setting and the like.

The display unit 207 of the on-vehicle wireless device 2 is composed of a monitor device (not shown) mounted to a dash-board part of the vehicle 5, and displays, for the occupant, image data created by the control unit 209 in an adaptation request process described later. The audio output unit 208 outputs, from a loudspeaker (not shown), audio data created by the control unit 209.

The control unit 209 of the on-vehicle wireless device 2 is composed of one or a plurality of microcomputers, and controls the processes performed in the GPS processing unit 201, the azimuth sensor 202, the vehicle speed acquisition unit 203, the wireless communication unit 204, the storage unit 205, the operation unit 206, the display unit 207, and the audio output unit 208.

In addition, the control unit 209 of the on-vehicle wireless device 2 is able to calculate the position, the azimuth, the speed and the like of the vehicle 5 on the link of the road map data by performing, based on the road map data, a map matching process on the position measured by the GPS processing unit 201, the azimuth and the angular velocity measured by the azimuth sensor 202, and the speed acquired by the vehicle speed acquisition unit 203.

Further, the control unit 209 of the on-vehicle wireless device 2 generates, as probe data S3, travel data including a position, an azimuth, a speed, and the like that occurs while the vehicle 5 travels, which travel data is information collected at predetermined time intervals or distance intervals. The control unit 209 stores the probe data S3 in the storage unit 205.

The on-vehicle wireless device 2 utilizes wireless communication with the road side wireless device 11, as means for transmitting the probe data S3 to the infrastructure side. While the on-vehicle wireless device 2 is communicably connected with the road side wireless device 11, the on-vehicle wireless device 2 provides the probe data S3 to the central device 4 in real time.

On the other hand, when the on-vehicle wireless device 2 is not communicably connected with the road side wireless device 11, the on-vehicle wireless device 2 accumulates the probe data S3 generated at any time, in the storage unit 205. When the on-vehicle wireless device 2 is again communicably connected with the road side wireless device 11, the on-vehicle wireless device 2 provides, to the central device 4, both the current probe data S3 and the past probe data S3 accumulated in the storage unit 205.

In the present embodiment, the on-vehicle wireless device 2 is a device configured to have the wireless communication function of performing wireless communication by Wi-Fi (Registered Trademark), and the navigation function of guiding the vehicle 5 to a destination by means of the monitor device mounted to the dash-board part of the vehicle 5. However, the on-vehicle wireless device 2 may be composed of a mobile phone terminal such as a smart phone, for example.

In this case, the operation unit 206 and the display unit 207 are implemented as a display unit such as a touch panel of the smart phone. The display unit displays a guide to the destination.

When the on-vehicle wireless device 2 is composed of a mobile phone terminal, the wireless communication unit 204 transmits its own probe data S3 by using a wireless communication line of the mobile phone to provide the probe data S3 to the road side wireless device 11.

When the on-vehicle wireless device 2 is composed of a mobile phone terminal and the mobile phone terminal is able to perform wireless communication by Wi-Fi, the wireless communication unit 204 can transmit the probe data S3 by using the wireless communication line of the mobile phone, and further can transmit the probe data S3 by performing wireless communication by Wi-Fi with the traffic signal controller 1*a*.

6. Signal Control by Central Device

Figure 7:
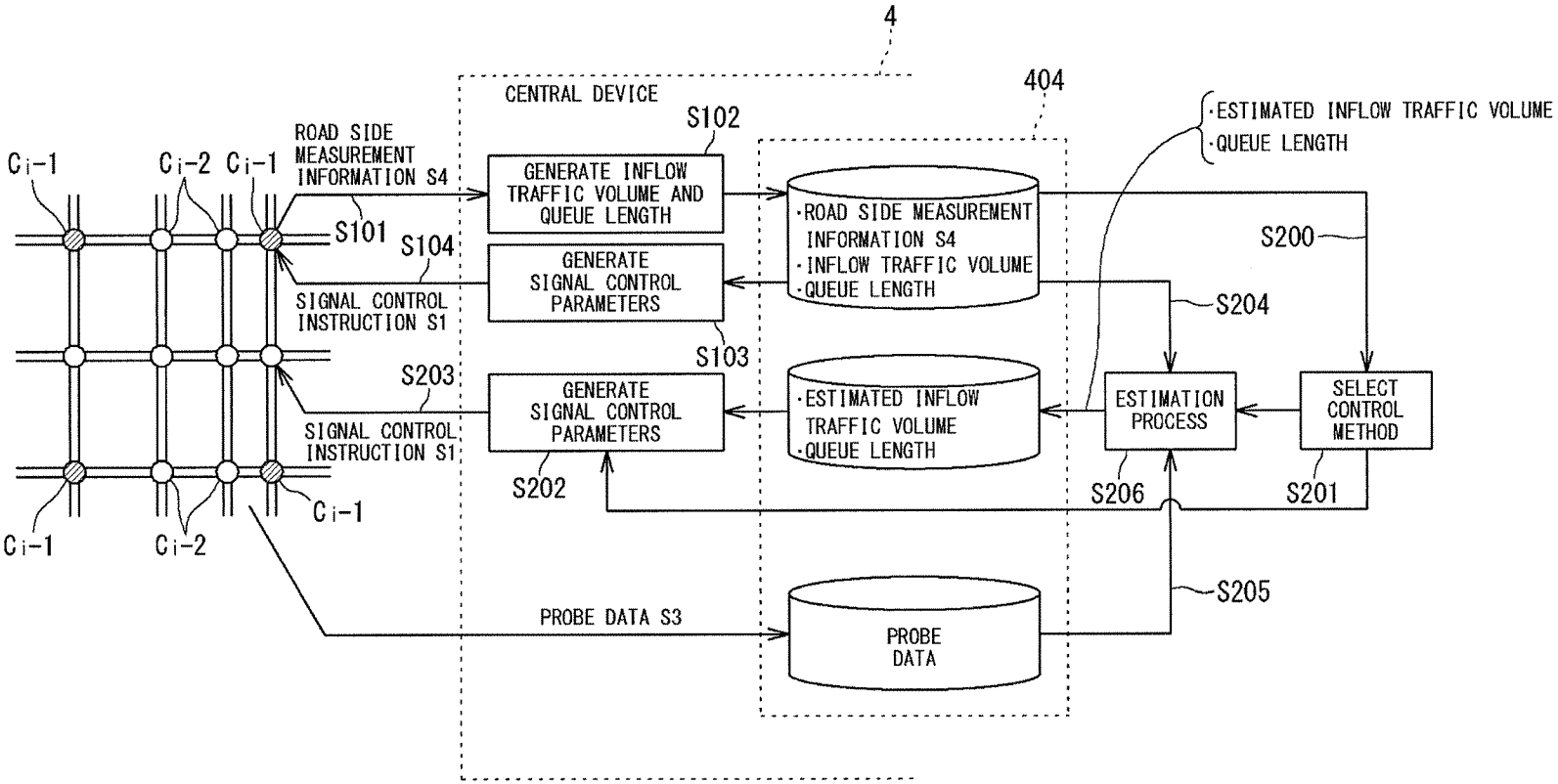
FIG. 7 is a diagram showing the content of a signal control process performed by a control processing unit of the central device.

FIG. 7 is a diagram showing the content of a signal control process performed by the control processing unit 412 of the central device 4.

In FIG. 7, a part of a control area including a plurality of intersections Ci is shown on the left side in the sheet of FIG. 7. As shown in FIG. 7, first intersections Ci-1 (hatched circles) in which the road side sensor 3 is installed and an inflow traffic volume (road side measurement information S4) can be obtained, and second intersections Ci-2 (white circles) in which the road side sensor 3 is not installed and an inflow traffic volume (road side measurement information S4) cannot be obtained are shown in the part of the control area.

Hereinafter, signal control relating to the first intersections Ci-1 will be described.

[6.1 Signal Control at First Intersection]

The (control processing unit 412 of) central device 4, as described above, executes the MODERATO control in which signal control is performed with a most appropriate signal control parameter generated by using a demand factor.

In order to obtain a demand factor, firstly, the central device 4 receives the road side measurement information S4 transmitted from the road side sensor 3 through the traffic signal controller 1*a* (step S101), and then the central device 4 obtains an inflow traffic volume (number of vehicles/time) and a queue length (number of vehicles) at an intersection Ci-1 as a control target, on the basis of the road side measurement information S4 (step S102).

The manner of obtaining a queue length by the (measurement processing unit 410 of) central device 4 will be described below.

Figure 8:
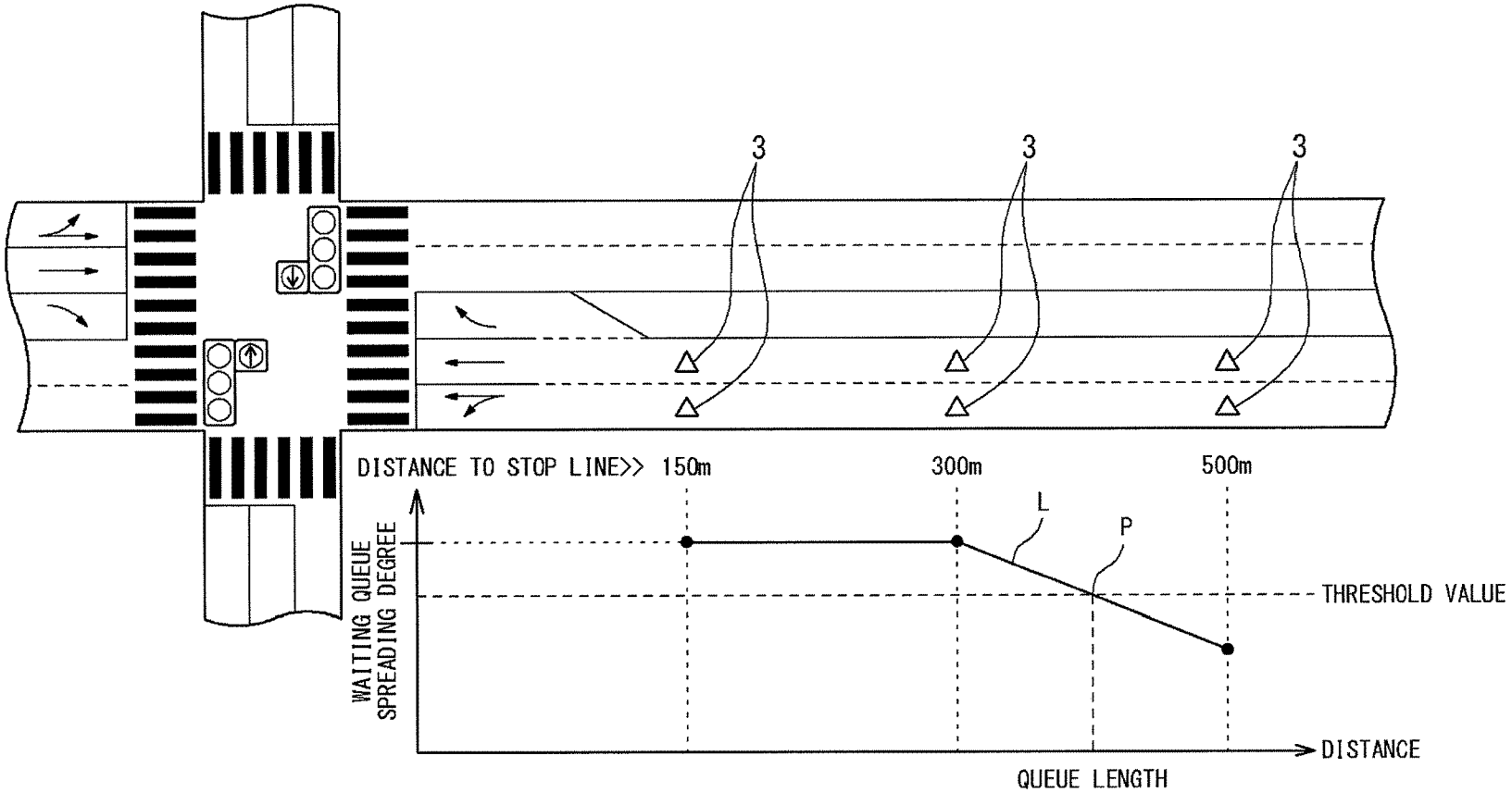
FIG. 8 is a diagram for explaining an example of a method for obtaining a queue length.

FIG. 8 is a diagram showing an example of a method for obtaining a queue length.

As shown in FIG. 8, the central device 4 obtains the speeds of vehicles traveling on the road, on the basis of the road side measurement information S4 obtained by a plurality of the road side sensors 3 located at predetermined positions on the upstream side of the stop line of the target intersection Ci, and obtains a waiting queue spreading degree from the speeds. FIG. 8 shows an exemplary case in which the road side sensor 3 is installed at positions 150 m, 300 m, and 500 m apart from the stop line of the intersection Ci. These positions of the road side sensors 3 are merely examples, and a plurality of the road side sensors 3 may be installed in a range of about 100 m to 500 m.

The waiting queue spreading degree is an index indicating the degree of spreading of a queue to the position of each road side sensor 3, and takes a value from 0 to 1.

The central device 4 obtains the waiting queue spreading degree of each road side sensor 3, and plots the obtained waiting queue spreading degree of each road side sensor 3 on a graph having a horizontal axis indicating the distance to the stop line, and a vertical axis indicating the waiting queue spreading degree, as shown in FIG. 8.

At this time, the central device 4 obtains an intersection P at which a line L connecting the plotted measurement points intersects a threshold value that is set in advance, and obtains a distance corresponding to this intersection P as a queue length. Further, the central device 4 convers the obtained queue length into the number of vehicles 5.

The threshold value is determined, in a preliminary investigation, by grasping the relationship between the waiting queue spreading degree and the queue length.

If the road side sensors 3 are installed at appropriate positions on the upstream side of the first intersection Ci-1 as the control target, the queue length can be obtained by the above-mentioned method. However, there are cases where the road side sensors 3 are not installed at the appropriate positions on the upstream side of the first intersection Ci-1 as the control target.

In this case, since the queue length cannot be obtained by the above-mentioned method, the measurement processing unit 410, for example, estimates the queue length by using the probe data, or estimates the queue length from the provided road side measurement information S4.

If the queue length cannot be obtained by the above-mentioned method or it is difficult to estimate the queue length on the basis of the probe data or the like, the measurement processing unit 410 may set the value of the queue length to "0".

In the manner described above, the central device 4 obtains the queue length at the first intersection Ci-1 as the control target by using the road side measurement information S4.

Next, the central device 4 stores the road side measurement information S4, the generated inflow traffic volume, and the generated queue length in the storage unit 404.

The central device 4 generates signal control parameters for the first intersection Ci-1 as the control target by using the inflow traffic volume and the queue length stored in the storage unit 404 (step S103).

First, the (control processing unit 412 of) central device 4 calculates a demand factor $\lambda_i$ of each road extending from the intersection, on the basis of the following equation (1):

[Math. 1]

$$\lambda_i = \max\left(\frac{E_{i(fl)} + q_{i(fl)}}{s_{i(fl)}}\right) \tag{1}$$

In the above equation (1), i is a numeral indicating each road extending from the intersection, and takes a value from 1 to 4 when roads extend in four directions from the intersection. In addition, fl is a numeral indicating a lane. If each road extending from the intersection has a plurality of lanes, fl is assigned to each lane.

In addition, $E_i$ is a queue length, $q_i$ is an inflow traffic volume, and $s_i$ is a saturated traffic flow rate (number of vehicles/time).

Regarding the saturated traffic flow rate, a value set in advance for the first intersection Ci-1 as the control target is used. Regarding the inflow traffic volume and the queue length, values stored in the storage unit 404 are used.

As shown in the equation (1), the demand factor $\lambda_i$ is calculated for each of the roads extending from the intersection. Regarding the demand factor $\lambda_i$, a value is calculated, for each of lanes included in one road, by dividing a sum of the queue length $E_i$ and the inflow traffic volume $q_i$ by the saturated traffic flow rate $s_i$, and a maximum value among the values calculated for the respective lanes is adopted as the demand factor $\lambda_i$ of this road.

Next, the control processing unit 412 of the central device 4 calculates a cycle length C on the basis of the following equation (2):

[Math. 2]

$$C = \frac{1.5L + 5}{1 - \lambda} \tag{2}$$

In the above equation (2), time L (sec) is a sum of yellow time and clearance time (all red time), and λ (sec) is a value (sum of demand factors) calculated by summing, for each intersection, the demand factors $\lambda_i$ of the respective roads extending from the intersection which are calculated by the equation (1).

Next, the control processing unit 412 of the central device 4 calculates split φ on the basis of the following equation (3):

[Math. 3]

$$\phi_j = \frac{\lambda_j}{\Sigma\lambda_j} \tag{3}$$

As shown in the above equation (3), split $\varphi_j$ is calculated by dividing the demand factor $\lambda_j$ calculated by the above equation (1) by the sum of demand factors.

It is noted that j is a number indicating any aspect in a four-branch intersection under two-phase control, and is represented by 1 or 2 in the case of the two-phase control.

If the split $\varphi_j$ is obtained by the above equation (3), green time can be calculated as shown by the following equation (4):

$$\text{green time } (j) = \varphi_j \times (C - L) \tag{4}$$

Further, the control processing unit 412 of the central device 4 calculates an offset by using the above-mentioned cycle length, split, traffic volume in each of to and fro directions, and the like.

In the manner described above, the central device 4 can calculate the cycle length, the split, and the offset which are signal control parameters (step S103).

With reference to FIG. 7, the central device 4 generates a signal control instruction S1 including the calculated signal control parameters. The central device 4 transmits the generated signal control instruction S1 toward the traffic signal controller 1*a* (first controller) that controls the traffic signal unit 1 of the first intersection Ci-1 as the control target (step S104).

Thus, the central device 4 can cause the traffic signal controller 1*a* of the first intersection Ci-1 to perform an operation based on the signal control of the device 4, thereby performing signal control relating to the first intersection Ci-1 in accordance with the MODERATO control.

Next, signal control relating to the second intersection Ci-2 will be described.

[6.2 Signal Control for Second Intersection]

The (control processing unit 412 of) central device 4 refers to the inflow traffic volume, stored in the storage unit 404, of a first intersection in the vicinity of a second intersection Ci-2 as a control target (step S200), and selects a signal control method for the second intersection Ci-2 on the basis of the inflow traffic volume (step S201).

After determining whether or not an inflow traffic volume at the second intersection Ci-2 as the control target can be estimated, the central device 4 selects whether signal control based on the MODERATO control using a demand factor, like that for the first intersection Ci-1, should be performed or fixed control using signal control parameters that are set in advance should be performed, on the basis of the inflow traffic volume at the first intersection in the vicinity of the second intersection Ci-2 as the control target, thereby switching the control method.

When selecting the fixed control, the central device 4 generates signal control parameters set for the fixed control (step S202), and generates a signal control instruction S1 including the signal control parameters and a fixed control start command. The central device 4 transmits the generated signal control instruction S1 toward a traffic signal controller 1*a* (second controller) that controls the traffic signal unit 1 at the second intersection Ci-2 as the control target (step S203).

Thus, the central device 4 can cause the traffic signal controller 1*a* at the second intersection Ci-2 to perform signal control based on the fixed control.

It is noted that, after being provided with the signal control instruction S1 including the fixed control start command, the traffic signal controller 1*a* executes the fixed control until a signal control instruction S1 including a fixed control end command is provided thereto.

On the other hand, when selecting the MODERATO control, the central device 4 refers to at least one of the inflow traffic volume of the first intersection adjacent to the second intersection Ci-2 as the control target (step S204) and the probe data (step S205), which are stored in the storage unit 404, and causes the estimation processing unit 411 to estimate the inflow traffic volume at the second intersection Ci-2 (step S206).

FIG. 9 is a diagram for explaining a method for estimating an inflow traffic volume at a second intersection Ci-2 adjacent to a first intersection Ci-1.

Here, the case is considered in which a first intersection Ci-1 is present on each of the upstream side and the downstream side of a second intersection Ci-2 as shown in (a) of FIG. 9.

Hereinafter, the first intersection Ci-1 on the upstream side of the second intersection Ci-2 is also referred to as an upstream side first intersection Ci-1, and the first intersection Ci-1 on the downstream side of the second intersection Ci-2 is also referred to as a downstream side first intersection Ci-1.

In (a) of FIG. 9, $Q_1(t)$ is an inflow traffic volume toward the upstream side of the first intersection Ci-1, $Q_a(t)$ is a traffic volume regarding left-turn at the upstream side first intersection Ci-1, and $Q_b(t)$ is a traffic volume regarding right-turn at the upstream side first intersection Ci-1.

In addition, $Q_2(t)$ is an inflow traffic volume toward the second intersection Ci-2, $Q_c(t)$ is a traffic volume regarding left-turn at the second intersection Ci-2, and $Q_d(t)$ is a traffic volume regarding right-turn at the second intersection Ci-2.

Further, $Q_3(t)$ is an inflow traffic volume toward the downstream side first intersection Ci-1.

It is noted that t represents unit time.

With the above definition, the inflow traffic volume $Q_1(t)$ toward the upstream side first intersection Ci-1 can be expressed as equation (5) in (b) of FIG. 9, by using the inflow traffic volume $Q_2(t)$ toward the second intersection Ci-2.

Accordingly, the inflow traffic volume $Q_2(t)$ toward the second intersection Ci-2 can be transformed to equation (6) in (b) of FIG. 9, and furthermore can be approximated to a value obtained by multiplying the inflow traffic volume $Q_1(t-1)$ toward the upstream side first intersection Ci-1 by coefficient k(t).

That is, since the inflow traffic volume $Q_1(t)$ toward the upstream side first intersection Ci-1 can be acquired by the road side sensor 3, an estimated value of the inflow traffic volume $Q_2(t)$ toward the second intersection Ci-2 can be calculated by using equation (6).

It is noted that the coefficient k(t) is set to different values for different time zones as shown in (b) of FIG. 9, on the basis of preliminary investigation for correlation between the upstream side first intersection Ci-1 and the second intersection Ci-2.

As described above, the estimated inflow traffic volume toward the second intersection Ci-2 can be obtained on the basis of the inflow traffic volume toward the adjacent upstream side first intersection Ci-1.

The inflow traffic volume $Q_2(t)$ toward the second intersection Ci-2 can be expressed as equation (7) in (b) of FIG. 9, by using the inflow traffic volume $Q_3(t)$ toward the downstream side first intersection Ci-1.

Accordingly, the inflow traffic volume $Q_2(t)$ toward the second intersection Ci-2 can be approximated to a value obtained by multiplying the inflow traffic volume $Q_3(t-1)$ toward the downstream side first intersection Ci-1 by coefficient h(t).

Also in this case, since the inflow traffic volume $Q_3(t)$ toward the downstream side first intersection Ci-1 can be acquired by the road side sensor 3, an estimated value of the inflow traffic volume $Q_2(t)$ toward the second intersection Ci-2 can be calculated by using the equation (7).

It is noted that the coefficient h(t) is set to different values for different time zones as shown in (b) of FIG. 9, on the basis of preliminary investigation for correlation between the downstream side first intersection Ci-1 and the second intersection Ci-2.

As described above, the estimated inflow traffic volume toward the second intersection Ci-2 can also be obtained on the basis of the inflow traffic volume of the adjacent downstream side first intersection Ci-1.

Thus, the estimated inflow traffic volume toward the second intersection Ci-2 can be obtained by using either the inflow traffic volume of the adjacent upstream side first intersection Ci-1 or the inflow traffic volume of the adjacent downstream side first intersection Ci-1.

It is noted that in (b) of FIG. 9, "p.m." and "a.m." indicate "afternoon" and "before noon", respectively. For example, "3 p.m." indicates "three o'clock in the afternoon".

Referring back to FIG. 7, the central device 4 further causes the estimation processing unit 411 to obtain a queue length at the second intersection Ci-2 (step S206).

Since the road side sensor 3 for obtaining an inflow traffic volume is not installed on the upstream side of the second intersection Ci-2 as the control target, it is not possible to obtain the queue length on the basis of the road side measurement information S4 from the road side sensor 3 as shown in FIG. 8, for example.

Therefore, the central device 4 causes the estimation processing unit 411 to estimate a queue length at the second intersection Ci-2 as the control target by a method using the probe data S3 (step S206).

FIG. 10 is a diagram for explaining a method for estimating a queue length at the second intersection Ci-2 by the estimation processing unit 411 of the central device 4.

First, the estimation processing unit 411 of the central device 4 compares a vehicle speed included in probe data S3 of a vehicle 5 which is provided in real time through the traffic signal controller 1*a* at each intersection Ci, with a sufficiently small threshold value ε (e.g., ε=2 km/hour), regards a time point at which the vehicle speed becomes smaller than the threshold value ε, as a stop time point t0 at which the vehicle speed becomes substantially zero, specifies the position of the vehicle 5 at this stop time point t0 by the vehicle position included in the probe data S3, and determines the position of the vehicle 5 at the stop time point t0, as a stop position x0 of the vehicle 5.

Next, the central device 4 calculates a queue length (number of vehicles) at the stop time point t0, on the basis of the determined stop position x0.

Specifically, as shown in FIG. 10, the central device 4 calculates a length Lg from the stop position x0 to a stop line H, and divides the length Lg by an effective vehicle length VL that is set in advance, to obtain the queue length at the stop time point t0.

As described above, the estimation processing unit 411 can obtain, by estimation, the queue length at the second intersection Ci-2 as the control target.

If the queue length cannot be obtained by the above-mentioned method, the estimation processing unit 411 may set the value of the queue length to "0".

In the manner described above, the central device 4 obtains the estimated inflow traffic volume and queue length at the second intersection Ci-2 as the control target.

Referring back to FIG. 7, the central device 4 stores the generated estimated inflow traffic volume and queue length in the storage unit 404.

The central device 4 generates signal control parameters for the second intersection Ci-2 as the control target by using the estimated inflow traffic volume and queue length stored in the storage unit 404 (step S202).

The manner of generating the signal control parameters is as described above. Regarding the inflow traffic volume in the above-mentioned method, the central device 4 generates the signal control parameters (cycle length, split, and offset) for the second intersection Ci-2 by using the estimated inflow traffic volume obtained by the estimation processing unit 411.

After obtaining the signal control parameters, the central device 4 generates, on the basis of the obtained signal control parameters, a signal control instruction S1 including the signal control parameters and a fixed control end command. The central device 4 transmits the generated signal control instruction S1 toward the traffic signal controller 1*a* (second controller) that controls the traffic signal unit 1 at the second intersection Ci-2 as the control target (step S203).

Thus, the central device 4 can cause the traffic signal controller 1*a* at the second intersection Ci-2 to end the signal control according to the fixed control, and to perform signal control according to the MODERATO control based on the estimated inflow traffic volume.

While the central device 4 is configured to perform selective switching between the MODERATO control and the fixed control (fixed-time control), the central device 4 may be configured to select, instead of the fixed control, interconnected control with the first intersection Ci-1 adjacent to the second intersection Ci-2 as the control target.

Alternatively, the central device 4 may be configured to select, instead of the fixed control, time control (multi-dial fixed-time control).

As described above, in the present embodiment, two control methods defined below are provided as switchable signal control methods to be performed by the central device 4 on the traffic signal controller 1*a* installed at the second intersection Ci-2.

Actuated method: a control method in which signal control parameters for a traffic signal controller 1*a* installed at a second intersection Ci-2 are generated on the basis of an estimated inflow traffic volume at the second intersection Ci-2, and which is implemented by the MODERATO control in the present embodiment.

Non-actuated method: a control method in which signal control parameters that are set in advance or signal control parameters being applied to an adjacent first controller are adopted as signal control parameters for a second controller, and which is implemented by the fixed control or the interconnected control in the present embodiment.

[6.3 Example of Signal Control by Central Device 4]

FIG. 11 is a diagram showing an example of signal control by the central device 4, and FIG. 12 is a flowchart showing a process procedure in FIG. 11.

Hereinafter, description is made focusing on a control area including nine intersections Ci on roads extending in a grid pattern as shown in FIG. 11.

In FIG. 11, (a) shows the control area in which no congestion occurs.

As shown in (a) of FIG. 11, in this control area, first intersections Ci-1 (black circles) at which road side sensors 3 are installed and second intersections Ci-2 (white circles) at which road side sensors 3 are not installed, are mixed.

In FIG. 11, regarding the signal control methods adopted in the respective intersections Ci, the MODERATO control, the fixed control, and the interconnected control are shown by different lines of squares surrounding the intersections Ci.

When the central device 4 does not detect congestion on the basis of the inflow traffic volume at each first intersection Ci-1, the central device 4 sets the signal control method for the second intersection Ci-2 to the fixed control or the interconnected control.

The central device 4 sets the signal control method for the first intersection Ci-1 to the MODERATO control regardless of whether or not congestion occurs.

Accordingly, as shown in (a) of FIG. 11, in the state where no congestion occurs, among the six second intersections Ci-2, the signal control method for the second intersection Ci-2 at the lower right corner in the sheet of (a) of FIG. 11 is set to the interconnected control, while the signal control methods of the remaining second intersections Ci-2 are set to the fixed control (step S501 in FIG. 12).

In the state where no congestion occurs, the signal control method for the first intersection Ci-1 is set to the MODERATO control.

When detecting congestion on the basis of the inflow traffic volume at each first intersection Ci-1 (step S502 in FIG. 12), the central device 4 specifies a second intersection Ci-2 for which the signal control method should be switched (step S503 in FIG. 12).

For example, the central device 4 specifies a second intersection Ci-2 of which inflow traffic volume can be estimated at the present stage, and specifies the second intersection Ci-2 of which inflow traffic volume can be estimated, as a second intersection Ci-2 for which the signal control method should be switched.

In (a) of FIG. 11, assuming that the four second intersections Ci-2 enclosed by a broken line 50 are intersections of which inflow traffic volumes can be estimated, the central device 4 switches the signal control method for these second intersections Ci-2 enclosed by the broken line 50.

In FIG. 11, (b) shows the case where the control area shown in (a) of FIG. 11 is under congestion.

As shown in (b) of FIG. 11, the central device 4 switches the signal control method of the four second intersections Ci-2 enclosed by the broken line 50 from the fixed control to the MODERATO control (step S504 in FIG. 12).

Regarding the signal control method for the first intersection Ci-1, the MODERATO control is maintained.

Thereafter, when detecting that the congestion is relieved on the basis of the inflow traffic volume at each first intersection Ci-1 (step S505 in FIG. 12), the central device 4 switches the signal control method for the four second intersections Ci-2 enclosed by the broken line 50 to the fixed control (step S506 in FIG. 12).

Thus, the signal control methods for the respective intersections Ci are restored to the state shown in (a) of FIG. 11.

As described above, the control processing unit 412 of the central device 4 is able to determine whether or not a first intersection Ci-1 is under congestion, on the basis of the inflow traffic volume at the first intersection Ci-1. When the first intersection Ci-1 is under congestion, the control processing unit 412 adopts the MODERATO control which is the actuated method, as the control method for the traffic signal controller 1*a* (second controller) at the second intersection Ci-2. When the first intersection Ci-1 is not under congestion, the control processing unit 412 adopts the non-actuated method such as the fixed control or the interconnected control, as the control method for the traffic signal controller 1*a* at the second intersection Ci-2.

In this case, by switching the signal control method as described above in the situation where the first intersections Ci-1 and the second intersections Ci-2 are mixed, the number of intersections Ci to be subjected to the MODERATO control can be increased during congestion. As the result, efficiency in traffic management in the control area under congestion can be improved.

On the other hand, when no congestion occurs, the signal control method for the second intersection Ci-2 is switched to the ordinary control such as the fixed control. Thus, an appropriate signal control method can be selected according to the traffic condition.

7. Effects

The central device 4 according to the present embodiment includes: the measurement processing unit 410 as an acquisition unit that acquires an inflow traffic volume at a first intersection Ci-1; the estimation processing unit 411 as an estimation unit that estimates an inflow traffic volume at a second intersection Ci-2 on the basis of at least one of the acquired inflow traffic volume at the first intersection Ci-1 and probe data obtained from a traveling vehicle 5; the control processing unit 412 as an information processing unit that generates signal control parameters for a traffic signal controller 1*a* at the first intersection Ci-1 on the basis of the acquired inflow traffic volume at the first intersection Ci-1, and generates signal control parameters for a traffic signal controller 1*a* at the second intersection Ci-2 on the basis of the estimated inflow traffic volume at the second intersection Ci-2; and the communication unit 403 that transmits the generated signal control parameters for the traffic signal controller 1*a* at the first intersection Ci-1 to the traffic signal controller 1*a* at the first intersection Ci-1, and transmits the generated signal control parameters for the traffic signal controller 1*a* at the second intersection Ci-2 to the traffic signal controller 1*a* at the second intersection Ci-2.

According to the above configuration, since the estimation processing unit 411 estimates an inflow traffic volume at the second intersection Ci-2 on the basis of the inflow traffic volume at the first intersection Ci-1, even if the inflow traffic volume at the second intersection Ci-2 cannot be obtained, signal control parameters can be generated on the basis of the inflow traffic volume estimated by the estimation processing unit 411, whereby signal control for the second intersection Ci-2 can be appropriately performed.

As the result, even when an intersection Ci at which an inflow traffic volume cannot be obtained is present, signal control can be appropriately performed at each intersection Ci, whereby efficiency in traffic management in the entire control area including a plurality of intersections Ci as control targets can be improved.

8. Modifications

FIG. 13 is a diagram for explaining a control mode relating to signal control for each intersection, according to a modification.

In this modification, the control processing unit 412 of the central device 4 executes a subarea connection determination process of determining whether or not a plurality of adjacent intersections should be included in the same subarea, in accordance with an inflow traffic volume at a first intersection Ci-1 as a traffic condition, and executes subarea connection on the basis of the result of the determination process.

As shown in (a) to (c) of FIG. 13, a subarea structure is considered in which a first intersection Ci-1 (black circle) is present at each of the upstream side and the downstream side of a second intersection Ci-2 (white circle).

Hereinafter, the first intersection Ci-1 on the upstream side of the second intersection Ci-2 is also referred to as an upstream side first intersection Ci-1, and the first intersection Ci-1 on the downstream side of the second intersection Ci-2 is also referred to as a downstream side first intersection Ci-1.

In FIG. 13, (a) shows a subarea structure in which no congestion occurs at the both first intersections Ci-1.

In this case, as shown in (a) of FIG. 13, the respective intersections Ci are not included in the same subarea.

As described above, when the central device 4 does not detect congestion on the basis of the inflow traffic volume at each first intersection Ci-1, the central device 4 sets the signal control method for the second intersection Ci-2 to the fixed control or the interconnected control, and sets the signal control method for the first intersection Ci-1 to the MODERATO control regardless of whether or not congestion occurs.

Accordingly, in (a) of FIG. 13, the signal control method for the both first intersections Ci-1 is set to the MODERATO control.

The signal control method for the second intersection Ci-2 is set to the fixed control method or the interconnected control method interlocked with either of the both first intersections Ci-1.

When the central device 4 detects congestion on the basis of the inflow traffic volumes at the both first intersections Ci-1, and then if the central device 4 determines that an inflow traffic volume at the second intersection Ci-2 can be estimated, the central device 4 switches the signal control method for the second intersection Ci-2 to the MODERATO control based on the estimated inflow traffic volume. Regarding the signal control method for the first intersection Ci-1, the MODERATO control is maintained.

Further, when detecting congestion, the central device 4 executes the subarea connection determination process for determining whether or not the respective intersections Ci should be included in the same subarea.

The central device 4 performs the determination process as follows. That is, first, the central device 4 specifies an intersection Ci as a determination target, and a neighboring intersection Ci adjacent to the target intersection Ci.

Next, the central device 4 performs calculation of an evaluation value described below, when a difference between the cycle length at the intersection Ci as the determination target and the cycle length at the neighboring intersection Ci is lower than or equal to a predetermined value (e.g., 5 to 10 sec).

The central device 4 calculates an evaluation value A for the case where the adjacent subareas (the intersection Ci as the determination target and the neighboring intersection Ci) are not connected (these intersections are not included in the same subarea) (pattern 1).

Further, the central device 4 calculates an evaluation value B for the case where the adjacent subareas (the intersection Ci as the determination target and the neighboring intersection Ci) are connected (these intersections are included in the same subarea) (pattern 2).

In the pattern 1, the central device 4 calculates an evaluation value (A) for the case where the adjacent subareas are subjected to coordinated control with their present cycle lengths.

Further, in the pattern 2, the central device 4 calculates an evaluation value (B) for the case where the cycle lengths of the adjacent subareas are set to the same cycle length. It is noted that, in the case of the pattern 2, a cycle length specified by a (later-described) predetermined setting method is adopted as a cycle length used for calculation.

The central device 4 compares the evaluation value A in the case of the pattern 1 with the evaluation value B in the case of the pattern 2, and determines that the adjacent subareas should be connected (determines that the adjacent intersections should be included in the same subarea) in the case where evaluation value A>evaluation value B; whereas determines that the adjacent subareas should not be connected (boundary should be maintained) (determines that the adjacent intersections should not be included in the same subarea) in the case where evaluation value A≤evaluation value B. When the adjacent subareas should be connected, the central device 4 sets the cycle lengths of the subareas to be connected, to the cycle length used for calculation of the evaluation value B.

An evaluation equation (evaluation condition) for calculating the evaluation values A and B can be expressed by, for example, the following equation (8):

$$\text{evaluation value } PI = D + (25/3600) \times S \tag{8}$$

The evaluation value PI in the case of the pattern 1 is the evaluation value A, and the evaluation value PI in the case of the pattern 2 is the evaluation value B.

In the equation (8), D is a delay time (number of vehicles·time/time), which is so-called signal waiting time. For example, the delay time D increases with an increase in the cycle length, and then the evaluation value PI increases, and the index deteriorates. The smaller the evaluation value PI is, the better the traffic condition is. When the cycle length is reduced more than necessary, vehicles at the intersection cannot be managed (cannot be allowed to pass), thereby increasing the delay time.

S is stop frequency (number of vehicles/time). Regarding the stop frequency S, when the adjacent subareas have different cycle lengths, pulsation which is disturbance of traffic flow is increased. As seen from the above equation (8), if the adjacent subareas have different cycle lengths, the stop frequency S increases, the evaluation value PI increases, and the index deteriorates.

The evaluation equation is not limited to the above equation (8). In the present invention, the smaller the evaluation value is, the more desirable the traffic condition is. Examples of the evaluation value may include: an evaluation value relating to smoothness, such as a delay time or a stop time at an intersection; an evaluation value relating to safeness, such as a risk of traffic accidents; and an evaluation value relating to environment, such as a heavy vehicles ratio, carbon dioxide emission.

The central device 4 specifies the cycle length to be used for calculation of the evaluation value B in the case of the pattern 2, by using a predetermined setting method as described above.

Examples of the setting method are as follows.

That is, when both the adjacent subareas (intersections Ci) are first intersections Ci-1, the central device 4 adopts, as a cycle length to be used for calculation, the cycle length of one of the first intersections Ci-1 which is longer than the cycle length of the other first intersection Ci-1.

When one of the adjacent subareas (intersections Ci) is a first intersection Ci-1 while the other adjacent subarea is a second intersection Ci-2, the central device 4 determines a cycle length to be used for calculation, on the basis of the reliability of the signal control parameters at the second intersection Ci-2.

When both the adjacent subareas (intersections Ci) are second intersections Ci-2, the central device 4 determines a cycle length to be used for calculation, on the basis of the reliabilities of the signal control parameters at the both second intersections Ci-2.

The signal control parameters at the second intersection Ci-2 are obtained from the estimated inflow traffic volume at the second intersection Ci-2. The estimation accuracy of the estimated inflow traffic volume may vary such that variation with respect to the actual inflow traffic volume may increase due to factors such as time zones. Therefore, the estimation accuracy of the estimated inflow traffic volume also influences the signal control parameters at the second intersection Ci-2.

The reliability of the signal control parameters is a value representing the degree of reliability obtained on the basis of the process for obtaining the signal control parameters. In the present embodiment, the reliability of the signal control parameters at the second intersection Ci-2 particularly indicates the degree of reliability taking into consideration the influence of the estimation accuracy of the estimated inflow traffic volume used in the process of obtaining the signal control parameters, and can be represented by values in multiple stages that are set in accordance with time zones.

For example, in a time zone where the traffic condition suddenly changes, deviation of the estimated inflow traffic volume from the actual inflow traffic volume is highly likely to be increased, and therefore the reliability of the signal control parameters is set to a low value. Conversely, in a time zone where change in the traffic condition is gentle and therefore the estimated inflow traffic volume is likely to coincide with the actual inflow traffic volume relatively easily, the reliability of the signal control parameters is set to a high value.

For example, when the reliability of signal control parameters at the second intersection Ci-2 is higher than or equal to a predetermined value that is set in advance, the central device 4 adopts the cycle length of the second intersection Ci-2 as a comparison target for the cycle length of the first intersection Ci-1 when the above-mentioned evaluation value B is calculated, and adopts the longer cycle length as a cycle length used for calculation.

When the reliability of signal control parameters at the second intersection Ci-2 is smaller than the predetermined value that is set in advance, the central device 4 adopts the cycle length at the first intersection Ci-1 as a cycle length used for calculation.

When both the adjacent subareas (intersections Ci) are second intersections Ci-2, the central device 4 adopts the cycle length of either of the second intersections Ci-2 which has the higher reliability of the signal control parameters, as a cycle length used for calculation.

As described above, the central device 4 compares the evaluation value A in the case of the pattern 1 with the evaluation value B in the case of the pattern 2, and determines whether or not the adjacent subareas should be connected, on the basis of the comparison result.

For example, it is assumed that the central device 4 executes the subarea connection determination process in the state shown in (a) of FIG. 13, and specifies the second intersection Ci-2 as a determination target, and the upstream side first intersection Ci-1 as an adjacent intersection Ci.

At this time, if a difference between the cycle length of the upstream side first intersection Ci-1 and the cycle length of the second intersection Ci-2 is greater than a predetermined value, the central device 4 does not regard the second intersection Ci-2 as a target of subarea connection, does not calculate the evaluation value, and does not execute subarea connection.

On the other hand, when the difference between the cycle length of the upstream side first intersection Ci-1 and the cycle length of the second intersection Ci-2 is smaller than or equal to the predetermined value, the central device 4 regards the second intersection Ci-2 as a target of subarea connection. Further, the central device 4 compares the evaluation value A in the case of the pattern 1 with the evaluation value B in the case of the pattern 2, and determines that the second intersection Ci-2 should be included in the subarea of the upstream side first intersection Ci-1 in the case where evaluation value A>evaluation value B, whereas determines that the second intersection Ci-2 should not be included in the subarea of the upstream side first intersection Ci-1 in the case where evaluation value A≤evaluation value B.

In FIG. 13, (b) shows an example of the subarea structure in the case where congestion is detected. In FIG. 13, (b) shows the state where, after the state shown in (a) of FIG. 13, the second intersection Ci-2 is included in the subarea of the upstream side first intersection Ci-1.

At this time, the cycle length at the second intersection Ci-2 is set to the same value as the cycle length of the upstream side first intersection Ci-1 because the second intersection Ci-2 is included in the same subarea as the upstream side first intersection Ci-1, and is also set to the cycle length used for calculation of the evaluation value B.

The setting method for the cycle length used for calculation of the evaluation value B in this case is as described above.

The central device 4, from the state shown in (b) of FIG. 13, further executes the subarea connection determination process.

That is, the central device 4 specifies the downstream side first intersection Ci-1 as a determination target, and the second intersection Ci-2 as an adjacent intersection, and executes the subarea connection determination process on these intersections.

At this time, if a difference between the cycle length of the second intersection Ci-2 and the cycle length of the downstream side first intersection Ci-1 is larger than a predetermined value, the central device 4 does not regard the downstream side first intersection Ci-1 as a target of subarea connection, does not obtain the above-mentioned evaluation value, and does not execute subarea connection.

On the other hand, when the difference between the cycle length of the second intersection Ci-2 and the cycle length of the downstream side first intersection Ci-1 is smaller than or equal to the predetermined value, the central device 4 regards the downstream side first intersection Ci-1 as a target of subarea connection. Further, the central device 4 compares the evaluation value A in the case of the pattern 1 with the evaluation value B in the case of the pattern 2, and determines that the downstream side first intersection Ci-1 should be included in the subarea of the second intersection Ci-2 in the case where evaluation value A>evaluation value B, whereas determines that the downstream side first intersection Ci-1 should not be included in the subarea of the second intersection Ci-2 in the case where evaluation value A≤evaluation value B.

In FIG. 13, (c) shows another example of the subarea structure when congestion is detected. In FIG. 13, (c) shows the state where, after the state shown in (b) of FIG. 13, the downstream side first intersection Ci-1 is included in the subarea of the second intersection Ci-2.

At this time, the cycle length of the downstream side first intersection Ci-1 is adjusted to the same value as the cycle lengths of the second intersection Ci-2 and the upstream side first intersection Ci-1 because the downstream side first intersection Ci-1 is included in the same subarea as the second intersection Ci-2 and the upstream side first intersection Ci-1, and is also set to the cycle length used for calculation of the evaluation value B.

As described above, according to this modification, in the subarea connection determination process executed when congestion occurs, when congestion occurs at the first intersection Ci-1, the second intersection Ci-2 for which the actuated control (MODERATO control) based on an estimated inflow traffic volume is equally treated to the first intersection Ci-1 (is regarded as a target of subarea connection), whereby the second intersection Ci-2 can be included in the same subarea as the adjacent intersection Ci in accordance with the traffic condition, whereby the efficiency of traffic management in the area to be controlled can be further improved.

Further, according to the modification, in the subarea connection determination process, the evaluation value A (the first 1evaluation value) and the evaluation value B (second evaluation value) are calculated. The evaluation value A is calculated from the above equation (8) (predetermined evaluation condition) when signal control is performed with the cycle lengths set for the first intersection Ci-1 and the second intersection Ci-2 adjacent to each other, respectively. The evaluation value B is calculated from the above equation (8) when signal control is performed such that the respective cycle lengths of the first intersection Ci-1 and the second intersection Ci-2 adjacent to each other are set to be the same value as the cycle length obtained on the basis of the reliability of the signal control parameters at the second intersection Ci-2. Then, on the basis of comparison between the evaluation value A and the evaluation value B, it is determined whether or not the first intersection Ci-1 and the second intersection Ci-2 adjacent to each other should be included in the same subarea.

In this case, more appropriate determination can be achieved because the determination is made after performing evaluation for the case of executing subarea connection and evaluation for the case of executing no subarea connection.

The subarea connection determination process according to the above embodiment is performed using only the reliability of the signal control parameters at the second intersection Ci-2, without using the reliability of the signal control parameters at the first intersection Ci-1. However, the subarea connection determination process may be performed by using the reliabilities of the signal control parameters at the first intersection Ci-1 and the second intersection Ci-2.

In this case, like the reliability of the signal control parameters at the second intersection Ci-2, the reliability of the signal control parameters at the first intersection Ci-1 is obtained on the basis of the process for obtaining the signal control parameters.

Further, in the above embodiment, regarding the setting method for the cycle length (cycle length used for calculation of the evaluation value B) adopted when subarea connection is performed, if one of the adjacent subareas (intersections Ci) is a first intersection Ci-1 while the other subarea is a second intersection Ci-2, the central device 4 is configured to determine a cycle length used for calculation on the basis of the reliability of the signal control parameters at the second intersection Ci-2, whereas when both the adjacent subareas (intersections Ci) are second intersections Ci-2, the central device 4 is configured to determine a cycle length used for calculation on the basis of the reliabilities of the signal control parameters thereof.

However, as a setting method for a cycle length used for calculation of the evaluation value B, a setting method may be adopted in which the cycle length of one of the adjacent subareas (intersections Ci) which is longer than the cycle length of the other subarea is adopted regardless of whether the adjacent intersections are first intersections Ci-1 or second intersections Ci-2.

In the above embodiment, the central device 4 is configured so as not to execute the subarea connection determination process when no congestion occurs at the first intersection Ci-1. However, if the central device 4 is configured to execute the subarea connection determination process even when no congestion occurs at the first intersection Ci-1, the central device 4 executes the subarea connection determination process with the second intersection Ci-2 being excluded from the target of subarea connection.

Meanwhile, if congestion occurs at the first intersection Ci-1, the central device 4 treats the second intersection Ci-2 equally to the first intersection Ci-1, and regards the second intersection Ci-2 as a target of subarea connection.

As described above, in the subarea connection determination process, the central device 4 is configured to treat the second intersection Ci-2 equally to the first intersection Ci-1 when a predetermined condition (occurrence of congestion at the first intersection Ci-1) is satisfied, and is configured so as not to regard the second intersection Ci-2 as a target of subarea connection when the predetermined condition is not satisfied.

9. Others

In the above embodiment, the central device 4 is configured to cause the traffic signal controller 1*a* at the second intersection Ci-2 to perform selective switching between the signal control based on the fixed control and the signal control based on the MODERATO control. However, the central device 4 may cause the traffic signal controller 1*a* at the second intersection Ci-2 to perform the signal control based on the MODERATO control at all times.

The above embodiments are merely illustrated in all aspects and should not be recognized as being restrictive. The scope of the present invention is defined by the scope of the claims rather than by the description above, and is intended to include meaning equivalent to the scope of the claims and all modifications within the scope.

REFERENCE SIGNS LIST

1 traffic signal unit
1*a* traffic signal controller
1*b* signal light unit
2 on-vehicle wireless device
3 road side sensor
4 central device
5 vehicle
6 communication line
7 router
9 probe data management device
10 wireless terminal
11 road side wireless device
50 broken line
101 control unit
102 light-unit driving unit
103 communication unit
104 storage unit
201 processing unit
202 azimuth sensor
203 vehicle speed acquisition unit
204 wireless communication unit
205 storage unit
206 operation unit
207 display unit
208 audio output unit
209 control unit
401 control unit
402 display unit
403 communication unit
404 storage unit
405 operation unit
410 measurement processing unit
411 estimation processing unit
412 control processing unit
S1 signal control instruction
S3 probe data
S4 road side measurement information

The invention claimed is:

1. A traffic signal control apparatus comprising:

an acquisition unit configured to acquire an inflow traffic volume at a first intersection defined below;

an estimation unit configured to estimate an inflow traffic volume at a second intersection defined below, on the basis of the acquired inflow traffic volume at the first intersection;

an information processing unit configured to generate a signal control parameter for a first controller defined below, on the basis of the acquired inflow traffic volume at the first intersection, and generate a signal control parameter for a second controller defined below, on the basis of the estimated inflow traffic volume at the second intersection; and a communication unit configured to transmit the generated signal control parameter for the first controller to the first controller, and to transmit the generated signal control parameter for the second controller to the second controller, wherein first intersection: an intersection at which a road side sensor is installed to obtain an inflow traffic volume at the intersection, second intersection: an intersection at which no road side sensor is installed, wherein no inflow traffic volume at the intersection is obtained, first controller: a traffic signal controller installed at the first intersection, and second controller: a traffic signal controller installed at the second intersection.

2. The traffic signal control apparatus according to claim 1, wherein two control methods defined below are provided as switchable control methods to be performed on the second controller by the information processing unit, wherein actuated method: a control method in which the signal control parameter for the second controller is generated on the basis of the estimated inflow traffic volume at the second intersection; and non-actuated method: a control method in which a preset signal control parameter or a signal control parameter being applied to an adjacent first controller is adopted as the signal control parameter for the second controller.

3. The traffic signal control apparatus according to claim 2, wherein the information processing unit is capable of determining whether or not the first intersection is under congestion, on the basis of the inflow traffic volume at the first intersection, and the information processing unit adopts the actuated method as the control method of the second controller in a case where the first intersection is under congestion, and adopts the non-actuated method as the control method of the second controller in a case where the first intersection in not under congestion.

4. The traffic signal control apparatus according to claim 1, wherein the information processing unit is capable of executing a subarea connection determination process of determining, on the basis of a traffic condition, whether or not a plurality of intersections adjacent to each other are included in the same subarea, and in the determination process, the information processing unit treats the second intersection equally to the first intersection in a case where a predetermined condition is satisfied, and does not regard the second intersection as a target of subarea connection in a case where the predetermined condition is not satisfied.

5. The traffic signal control apparatus according to claim 4, wherein the predetermined condition is that the first intersection is under congestion.

6. A computer program for causing a computer to function as the traffic signal control apparatus according to claim 1.

7. The traffic signal control apparatus according to claim 1, wherein the estimation unit estimates the inflow traffic volume at the second intersection, on the basis of the acquired inflow traffic volume at the first intersection, and probe data acquired from a traveling vehicle.

8. A traffic signal control apparatus comprising:

an acquisition unit configured to acquire an inflow traffic volume at a first intersection defined below;

an estimation unit configured to estimate an inflow traffic volume at a second intersection defined below, on the basis of the acquired inflow traffic volume at the first intersection;

an information processing unit configured to generate a signal control parameter for a first controller defined below, on the basis of the acquired inflow traffic volume at the first intersection, and generate a signal control parameter for a second controller defined below, on the basis of the estimated inflow traffic volume at the second intersection; and a communication unit configured to transmit the generated signal control parameter for the first controller to the first controller, and to transmit the generated signal control parameter for the second controller to the second controller, wherein first intersection: an intersection at which an inflow traffic volume can be obtained, second intersection: an intersection at which an inflow traffic volume cannot be obtained, first controller: a traffic signal controller installed at the first intersection, and second controller: a traffic signal controller installed at the second intersection, wherein the information processing unit is capable of executing a subarea connection determination process of determining, on the basis of a traffic condition, whether or not a plurality of intersections adjacent to each other are included in the same subarea, and the determination process includes:

calculating a first evaluation value obtained from a predetermined evaluation condition in a case where signal control is performed with cycle lengths respectively set at a plurality of intersections adjacent to each other, and a second evaluation value obtained from the predetermined evaluation condition in a case where signal control is performed such that each of the respective cycle lengths of the plurality of intersections adjacent to each other is set to be the same value as a cycle length which is obtained based on reliability indicating a degree of reliability obtained based on a process for obtaining a signal control parameter at each intersection; and determining whether or not the plurality of intersections adjacent to each other are included in the same subarea, on the basis of comparison between the first evaluation value and the second evaluation value.

9. A traffic signal control method comprising:

acquiring an inflow traffic volume at a first intersection defined below;

estimating an inflow traffic volume at a second intersection defined below, on the basis of the acquired inflow traffic volume at the first intersection;

generating a signal control parameter for a first controller defined below, on the basis of the acquired inflow traffic volume at the first intersection, and generating a signal control parameter for a second controller defined below, on the basis of the estimated inflow traffic volume at the second intersection; and transmitting the generated signal control parameter for the first controller to the first controller, and transmitting the generated signal control parameter for the second controller to the second controller, wherein first intersection: an intersection at which a road side sensor is installed to obtain an inflow traffic volume at the intersection, second intersection: an intersection at which no road side sensor is installed, wherein no inflow traffic volume at the intersection is obtained, first controller: a traffic signal controller installed at the first intersection, and second controller: a traffic signal controller installed at the second intersection.

* * * * *